US011313154B2

(12) United States Patent
Weng

(10) Patent No.: US 11,313,154 B2
(45) Date of Patent: Apr. 26, 2022

(54) LAPTOP LOCK

(71) Applicant: SINOX CO., LTD, New Taipei (TW)

(72) Inventor: Chia-Wei Weng, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 286 days.

(21) Appl. No.: 16/353,503

(22) Filed: Mar. 14, 2019

(65) Prior Publication Data

US 2019/0284843 A1 Sep. 19, 2019

Related U.S. Application Data

(60) Provisional application No. 62/643,306, filed on Mar. 15, 2018.

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC ..... E05B 73/0005; E05B 73/0082; F16M 11/041
USPC ..... 70/58; 361/679.57, 679.58; 248/176.1, 248/451, 316.2, 316.4, 316.5
See application file for complete search history.

(56) References Cited

U.S. PATENT DOCUMENTS 5,836,183 A * 11/1998 Derman ..... E05B 73/0082 70/58
6,216,499 B1 * 4/2001 Ronberg ..... E05B 73/0082 248/551
7,724,520 B2 * 5/2010 Allen ..... E05B 73/0082 361/679.57
8,061,164 B2 * 11/2011 Johnston ..... E05B 73/0082 70/58
8,837,144 B1 * 9/2014 Allen ..... A47F 3/002 361/679.57
2001/0038062 A1 * 11/2001 Galant ..... E05B 73/0082 248/551
2003/0164010 A1 * 9/2003 Galant ..... E05B 73/0082 70/58
2007/0290115 A1 * 12/2007 Meyer ..... E05B 73/0082 248/346.06
2010/0079285 A1 * 4/2010 Fawcett ..... G08B 13/149 340/568.1
2010/0096517 A1 * 4/2010 Lampman ..... E05B 73/0082 248/125.7
2011/0133050 A1 * 6/2011 Eisenberger, Sr ..... F16M 13/00 248/551
2011/0185776 A1 * 8/2011 Mahaffey ..... H05K 5/0204 70/58
2013/0099087 A1 * 4/2013 Li ..... F16M 11/10 248/551
2014/0145050 A1 * 5/2014 Hung ..... F16M 13/00 248/274.1
2014/0238091 A1 * 8/2014 Allen ..... A47F 7/024 70/58

(Continued)

*Primary Examiner* — Lloyd A Gall
(74) *Attorney, Agent, or Firm* — Birch, Stewart, Kolasch & Birch, LLP

(57) ABSTRACT

A laptop lock used for locking a laptop is provided. The laptop lock includes a body and a fixing device. The fixing device makes the relative position of the body with respect to the laptop fixed and makes extending direction of the shaft connecting the display and the keyboard part of the laptop parallel with the long axial direction of the body.

8 Claims, 34 Drawing Sheets

(56) References Cited

U.S. PATENT DOCUMENTS

| | | | | |
|---|---|---|---|---|
| 2017/0124357 | A1* | 5/2017 | Leyden | G06F 21/88 |
| 2018/0252003 | A1* | 9/2018 | Klinkman | G06F 1/1632 |
| 2018/0255922 | A1* | 9/2018 | Theis | F16M 11/041 |
| 2020/0073438 | A1* | 3/2020 | Huang | G06F 1/1632 |

* cited by examiner 904
360
100
260
800
904
160
366
260

141
904
260
360
366
800

LAPTOP LOCK

CROSS REFERENCE TO RELATED APPLICATIONS

This nonprovisional application claims the benefit of U.S. Provisional Application No. 62/643,306 filed on Mar. 15, 2018. The entire contents of the above applications are hereby incorporated by reference.

BACKGROUND OF THE INVENTION

1. Field of the Invention

The present invention generally relates to a laptop lock used for locking a laptop.

2. Description of the Prior Art

Laptop locks are developed to against thieves. Laptop locks can be connected to the lock hole of laptops by a latch unit, wherein a locking operation enables the latch unit to be secured in the lock hole when the latch unit has been connected to the lock hole. An arrangement of the lock hole and a lock connected thereto usually do not interfere with a user's operation and the lock hole is located at a side of a laptop. For example, a lock can approach the lock hole of the laptop located at a back side to let a latch unit thereof enter the lock hole without interfering with the operation of the lock or the laptop. However, since the laptop is getting thinner, the thickness on the side is therefore reduced; meanwhile, the size of the lock may affect the alignment between the latch unit and the lock hole. Consequently, the lock and the laptop may not both rest on a supporting face after the latch unit of the lock is inserted into the lock hole, wherein the back side of the laptop may be raised due to the lock, which may therefore affect the user's operation and the lock's efficacy.

SUMMARY OF THE INVENTION

It is an object of the present invention to provide a laptop lock used for locking a laptop, wherein a case of inability of locking and attaching caused by limits of the laptop can be reduced.

The laptop lock includes a body and a fixing device, wherein the fixing device makes the relative position of the body with respect to the laptop fixed and makes extending direction of the shaft connecting the screen and the keyboard part of the laptop parallel with the long axial direction of the body.

In one aspect, the laptop lock used for locking a laptop includes a body and a fixing device. The body has a support surface, wherein the support surface is provided with a first jack and a second jack at two opposite ends of the support surface close to the body. The fixing device includes a first member bar and a second member bar, wherein the first member bar and the second member bar are connected by a first connecting part and a second connecting part. The fixing device is able to sleeve the screen for making the screen of the laptop pass through a gap between the first member bar and the second member bar, making the first connecting part and the second connecting part be inserted respectively into the first jack and the second jack, making the relative position of the body with respect to the laptop fixed, and making extending direction of the shaft connecting the screen and the keyboard part of the laptop parallel with the long axial direction of the body.

In one aspect, the laptop lock is used together with a lockset for locking the laptop. The body further includes a lock hole disposed outside the support surface, wherein when the first connecting part and the second connecting part are inserted respectively into the first jack and the second jack, the lockset can insert into the lock hole to limit the movement of the fixing device relative to the body.

In one aspect, the body further includes a lock and a control component, wherein the first connecting part and the second connecting part can be inserted respectively into the first jack and the second jack to limit the movement of the fixing device relative to the body. When the lock is in the locked state, the lock interferes with the fixing device, thereby limiting movement of the fixing device relative to the body. When the lock is in an unlocked state, the control component can be pressed to release the interference of the lock on the fixing device, thereby releasing the movement limit of the fixing device relative to the body.

In one aspect, the laptop lock is used together with a cord for locking the laptop. The body further includes a lock hole disposed outside the support surface. When the first connecting part and the second connecting part are inserted respectively into the first jack and the second jack, one end of the cord can be inserted into the lock hole and limited from leaving the lock hole by the lock.

In one aspect, the laptop lock includes a body, a first support arm, a second support arm, and a fixing device. The body includes a support surface. The first support arm can move outwards relative to one end of the body. The second support arm can move outwards relative to the other end of the body. The fixing device includes a support unit, a first limiting unit, and a second limiting unit. The support unit is arranged on the support surface, wherein the support unit can be rotationally lifted relative to the support surface. The first limiting unit is arranged on the surface of the first support arm, wherein the first limiting unit can be rotationally lifted relative to the support surface along the opposite direction with respect to the rotation direction of the support unit. The second limiting unit is arranged on the surface of the second support arm, wherein the second limiting unit can be rotationally lifted relative to the support surface along the opposite direction with respect to the rotation direction of the support unit. The first support arm and the second support arm can move outwards relative to two ends of the body for making the screen of the laptop be positioned between the support unit, the first limiting unit, and the second limiting unit, making the relative position of the body with respect to the laptop fixed, and making extending direction of the shaft connecting the screen and the keyboard part of the laptop parallel with the long axial direction of the body.

In one aspect, the laptop lock is used together with a lockset for locking the laptop. The body further includes a lock hole disposed outside the support surface. The lockset can insert into the lock hole to limit the movement of the first support arm and the second support arm with respect to the opposite ends of the body.

In one aspect, the laptop lock includes a body, a first support arm, a second support arm, and a fixing device. The body includes a support surface. The first support arm can move outwards relative to one end of the body. The second support arm can move outwards relative to the other end of the body. The fixing device includes a first limiting unit and a second limiting unit. The first limiting unit is arranged on the surface of the first support arm, wherein the first limiting unit can be rotationally lifted relative to the support surface. The second limiting unit is arranged on the surface of the second support arm, wherein the second limiting unit can be rotationally lifted relative to the support surface. The first support arm and the second support arm can move outwards relative to two ends of the body for making the screen of the laptop be positioned between the first limiting unit and the second limiting unit, making the relative position of the body with respect to the laptop fixed, and making extending direction of the shaft connecting the screen and the keyboard part of the laptop parallel with the long axial direction of the body.

In one aspect, the laptop lock is used together with a lockset for locking the laptop. The body further includes a lock hole disposed outside the support surface. The lockset can insert into the lock hole to limit the movement of the first support arm and the second support arm with respect to the opposite ends of the body.

In one aspect, the laptop lock used together with a lockset for locking a laptop. The laptop lock includes a body and a fixing device. A lock hole is disposed on a side face of the body for the lockset to lock therein. The fixing device extends from one end of the body and can be inserted into and fixed at the other end of the body for making the relative position of the body with respect to the laptop fixed, and making extending direction of the shaft connecting the screen and the keyboard part of the laptop parallel with the long axial direction of the body.

In one aspect, the laptop lock used together with a lockset for locking a laptop. The laptop lock includes a body and a fixing device. The first support arm can extend out of an end of the body along a long axial direction of the body. The first support arm includes a lock hole, a support arm extending part, and a fixing device. The lock hole is disposed at an end portion of the first support arm. The support arm extending part extends along the direction perpendicular to the long axial direction of the body. The fixing device extends from one end of the support arm extending part and can be fixed at one end of the body for making the relative position of the body with respect to the laptop fixed, and making extending direction of the shaft connecting the screen and the keyboard part of the laptop parallel with the long axial direction of the body.

BRIEF DESCRIPTION OF THE DRAWINGS

FIGS. 1A to 1C-6 are perspective views of embodiments of the invention.

FIGS. 1D to 1F-5 are perspective views of embodiments of the invention.

FIGS. 1G-1 to 1G-6 are perspective views of embodiments of the invention.

FIGS. 2A-1 to 2F are perspective views of embodiments of the invention.

FIGS. 2G-1 to 2K are perspective views of embodiments showing the mechanisms which achieve relative movement of the first support arm and the second support arm with respect to the body.

FIGS. 3A to 3H are perspective views of embodiments of the invention.

FIGS. 4A to 4F-4 are perspective views of embodiments of the invention.

FIGS. 5A to 5I-2 are perspective views of embodiments of the invention.

DETAILED DESCRIPTION OF THE INVENTION

The present invention relates to a laptop lock. More specifically, the present invention relates to a laptop lock used for a laptop. The laptop lock includes a body and a fixing device. The fixing device makes the relative position of the body with respect to the laptop fixed and makes extending direction of the shaft connecting the screen and the keyboard part of the laptop parallel with the long axial direction of the body.

Figure 1A:
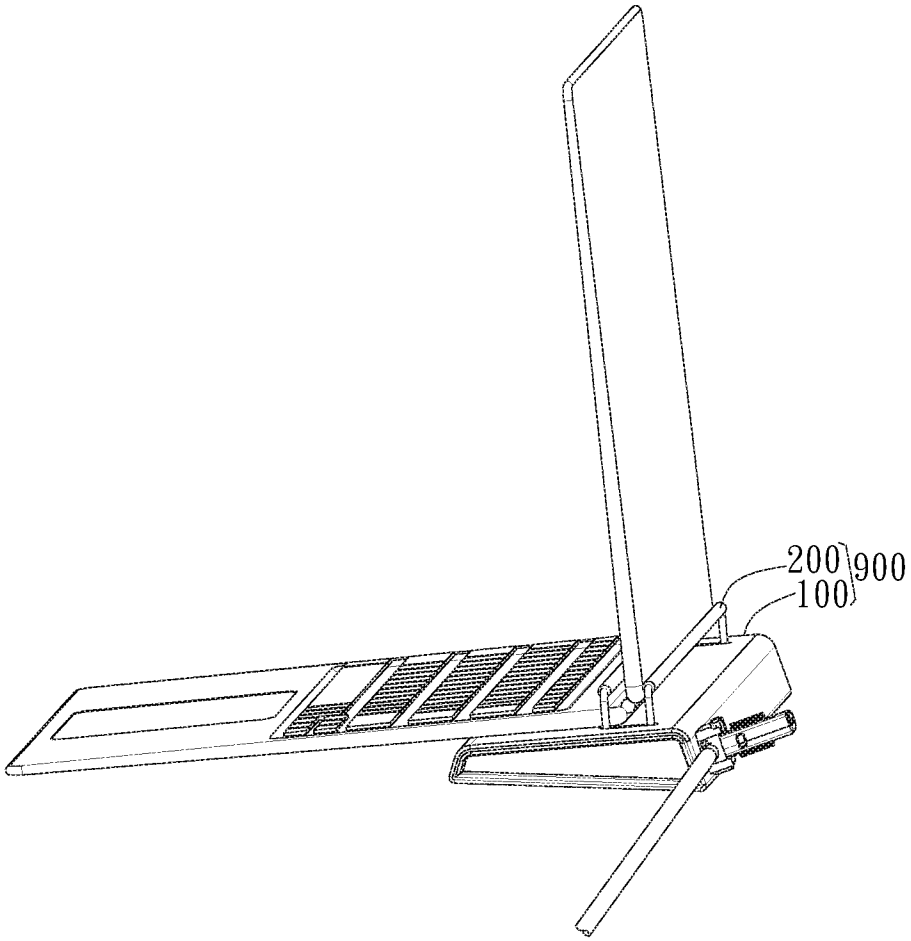

As the embodiment shown in FIG. 1A, a laptop lock 900 provided by the present invention includes a body 100 and a fixing device 200. As the embodiments shown in FIGS. 1B-1 to 1B-5, the body 100 is provided with a support surface 101, and the support surface 101 is provided with jacks 130 and 140 at two opposite ends of the support surface 101 close to the body 100. The fixing device 200 includes member bars 210 and 220, and a gap Lg is formed between the member bars 210 and 220, wherein the member bars 210 and 220 are connected by connecting parts 230 and 240, and the connecting parts 230 and 240 can be inserted into the jacks 130 and 140. More particularly, as the embodiment shown in FIG. 1A, the connecting parts 230 and 240 are bent parts. As the embodiments shown in FIGS. 1B-4 and 1B-6, preferably, the body 100 includes a lock hole 110 and a shielding plate 151, and a shielding plate operating button 150 can be used for operating the shielding plate 151 to move so as to enable the lock hole 110 to be shielded (referring to FIG. 1B-6) or exposed (referring to FIG. 1B-5).

Figures 1, 1B, 2, 3:
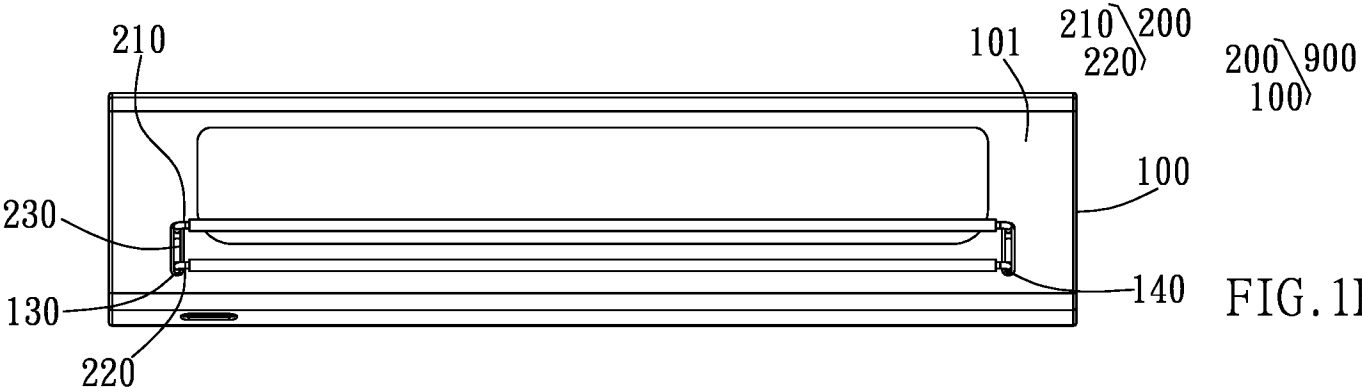
Figures 1, 1B, 2, 3, 4:
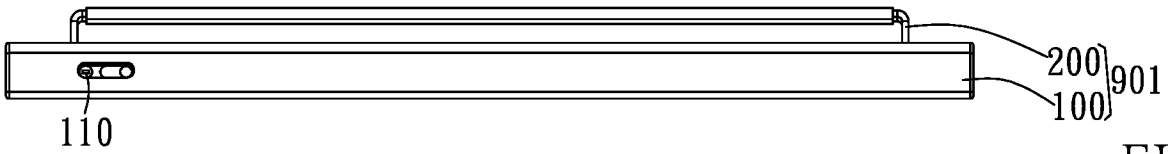
Figures 1, 1B:
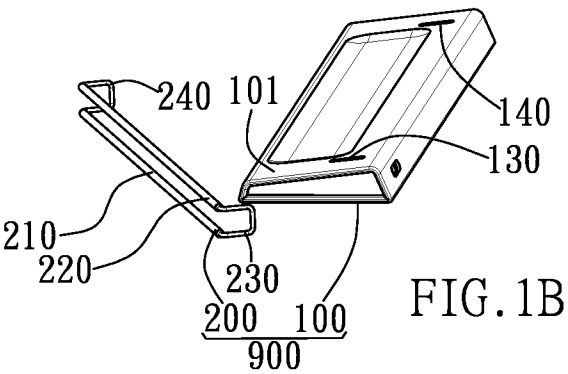
Figures 1, 1B, 2:
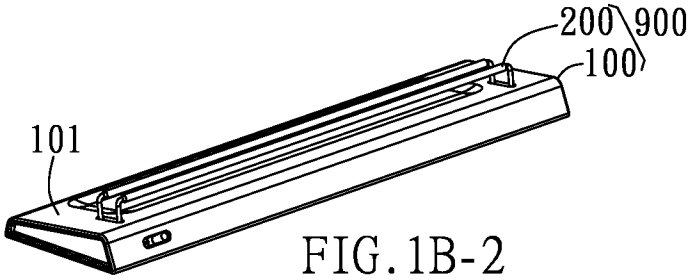
Figures 1, 1B, 2, 3, 4, 5:
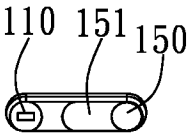
Figures 1, 1B, 2, 3, 4, 5, 6:
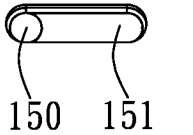
Figures 1, 1C:
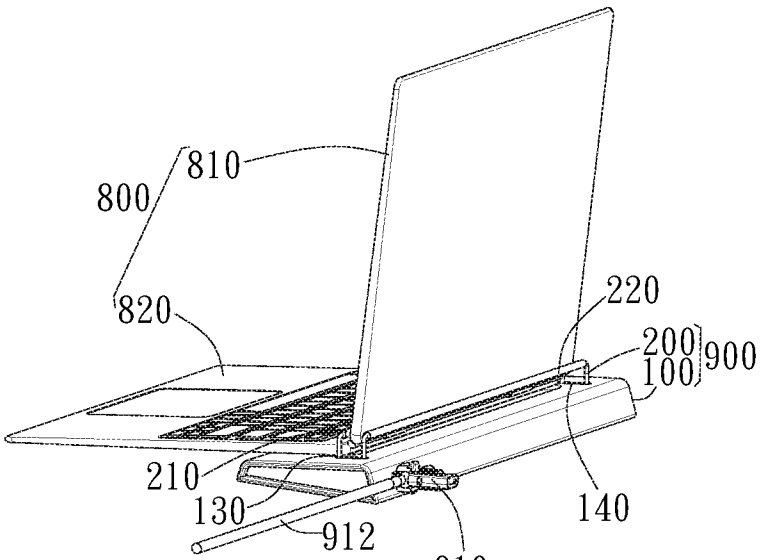
Figures 1, 1C, 2, 3, 4, 5:
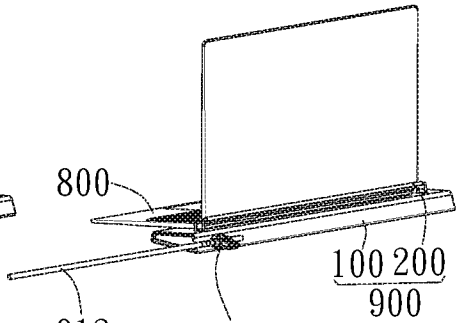
Figures 1, 1C, 2, 3, 4:
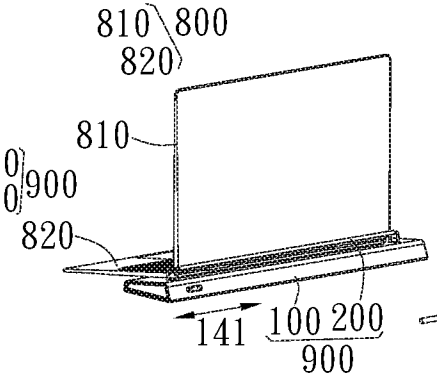
Figures 1, 1C, 2, 3, 4, 5, 6:
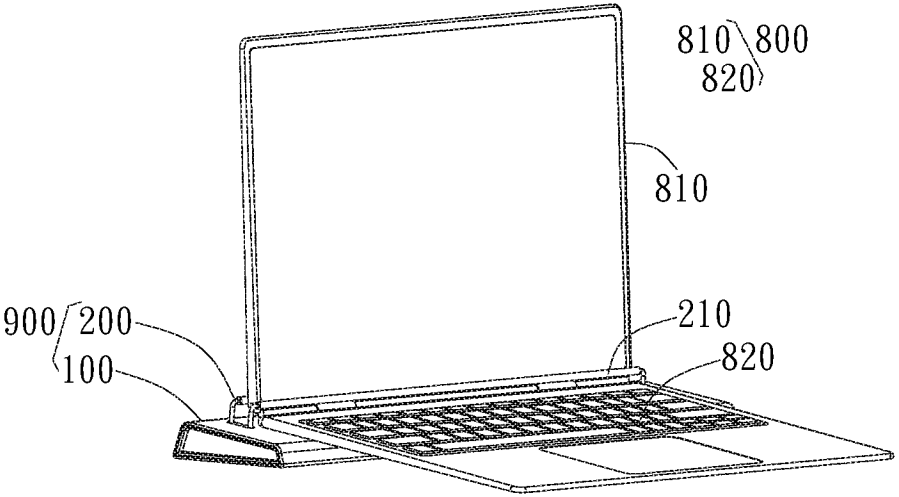
Figures 1, 1C, 2, 3:
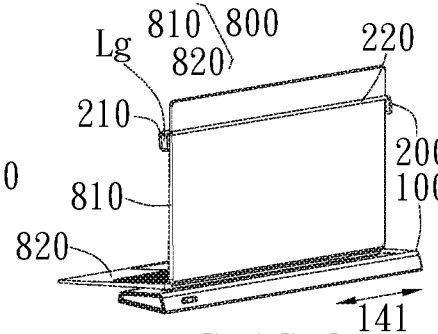
Figures 1, 1C, 2:
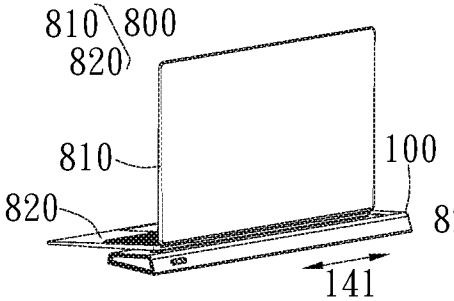

As the embodiments shown in FIGS. 1C-1 to 1C-6, the laptop lock 900 provided by the present invention can be used together with a lockset 910, and a laptop 800 is locked and attached to the body 100 by the fixing device 200. More particularly, a user can take out the laptop lock 900 firstly, the shaft 830 connecting the screen 810 and the keyboard part 820 of the laptop 800 is arranged on the body 100 as shown in FIG. 1C-2, then the screen 810 is lifted to enable the screen 810 to pass through the gap Lg between the member bars 210 and 220 of the fixing device 200, i.e. the fixing device 200 sleeves the screen 810, and then, the bent parts 230 and 240 are inserted into the jacks 130 and 140 (referring to FIG. 1B-5). Subsequently, the shielding plate operating button 150 is used for moving the shielding plate 151 to expose the lock hole 110 (referring to FIG. 1B), the lockset 910 is inserted into the lock hole 110 to enable the lockset 910 to be in a locked state, and then, the laptop 800 can be locked and attached to the body 100 as shown in FIG. 1C-6. When the lockset 910 is inserted into the lock hole 110, the lockset 910 interferes with the fixing device 200, thereby limiting movement of the fixing device 200 relative to the body 100 so as to enable the laptop to be locked and attached to the body 100.

As the embodiment shown in FIG. 1C-5, the lockset 910 can include a cord 912 for being fixed to other objects. For example, the cord 912 can be bound to a table leg. The surfaces of the member bars 210 and 220 can be covered with soft substances such as rubber so as to prevent the screen 810 from being damaged.

Figure 1D:
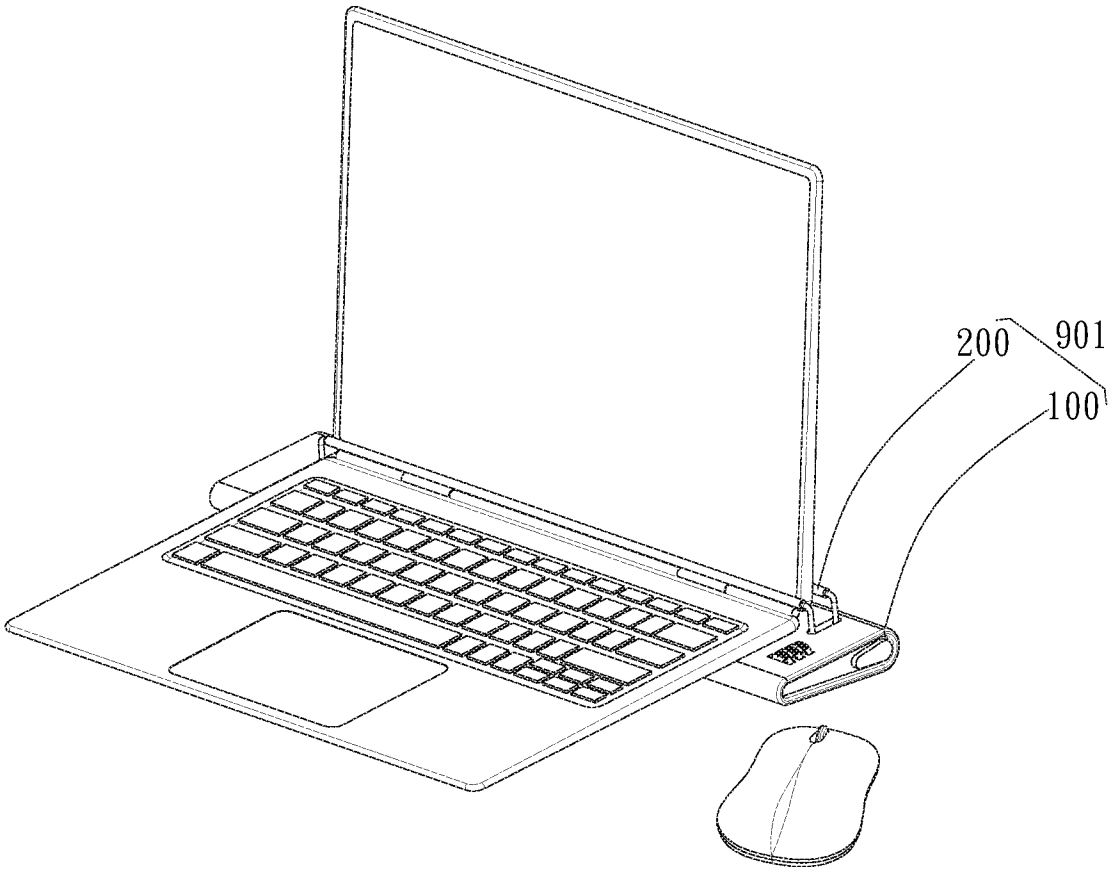
Figures 1, 1E:
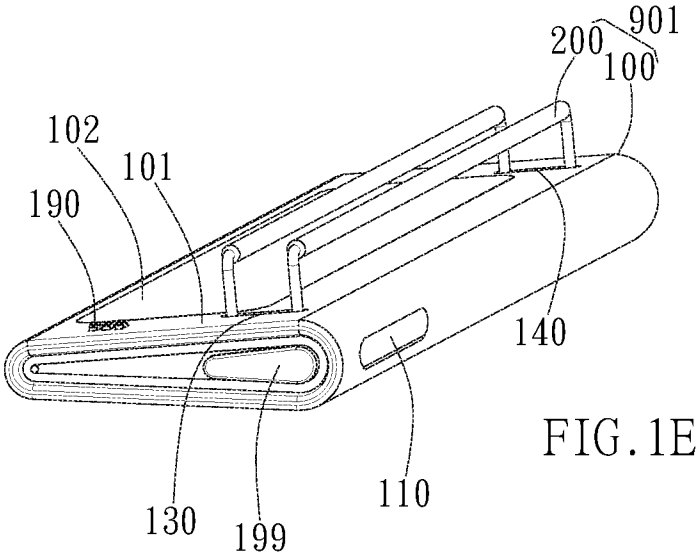
Figures 1, 1E, 2:
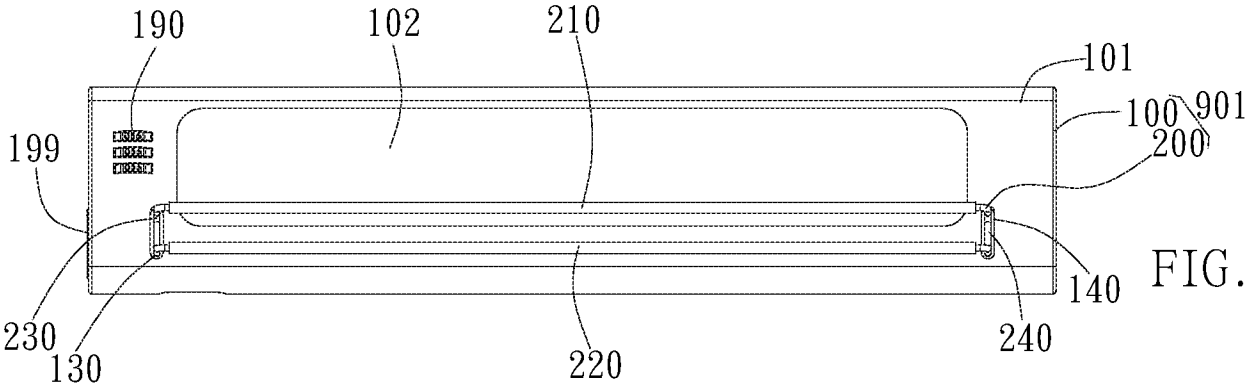
Figures 1, 1E, 2, 3:
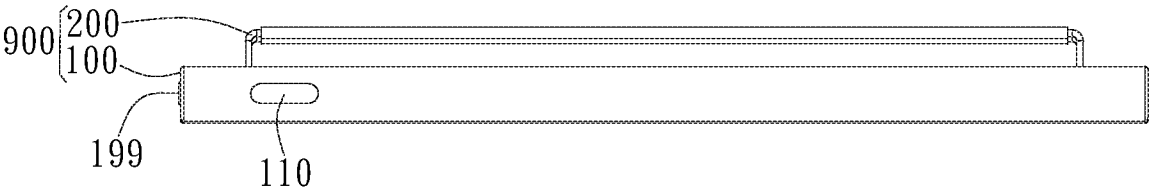

As the embodiment shown in FIG. 1D, the laptop lock 901 provided by the present invention includes a body 100 and a fixing device 200. As the embodiments shown in FIGS.

1E-1 to 1E-3, the body 100 is provided with a support surface 101, and the support surface 101 is provided with jacks 130 and 140 at two opposite ends of the support surface 101 close to the body 100. The support surface 101 is also provided with a gasket 102 so as to increase the friction force and reduce damage caused by collision. The fixing device 200 includes member bars 210 and 220, and a gap is formed between the member bars 210 and 220, where the member bars 210 and 220 are connected by connecting parts 230 and 240, and the connecting parts 230 and 240 can be inserted into the jacks 130 and 140. The body 100 includes a lock 190, a control component 199, and a lock hole 110.

Figures 1, 1F, 2, 3:
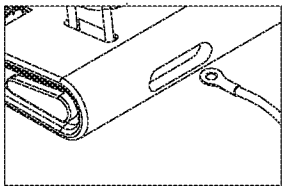
Figures 1, 1F, 2, 3, 4:
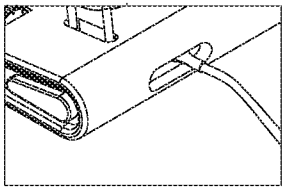
Figures 1, 1F, 2, 3, 4, 5:
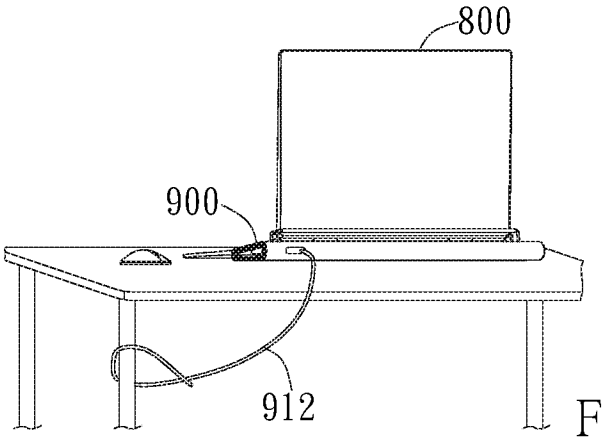
Figures 1, 1F:
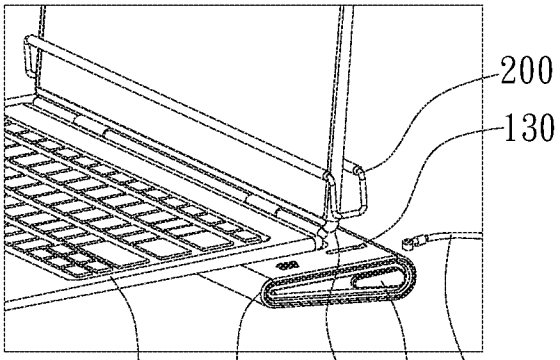
Figures 1, 1F, 2:
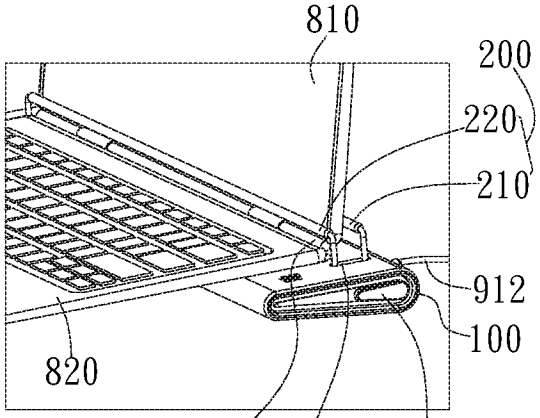
Figures 1, 1G:
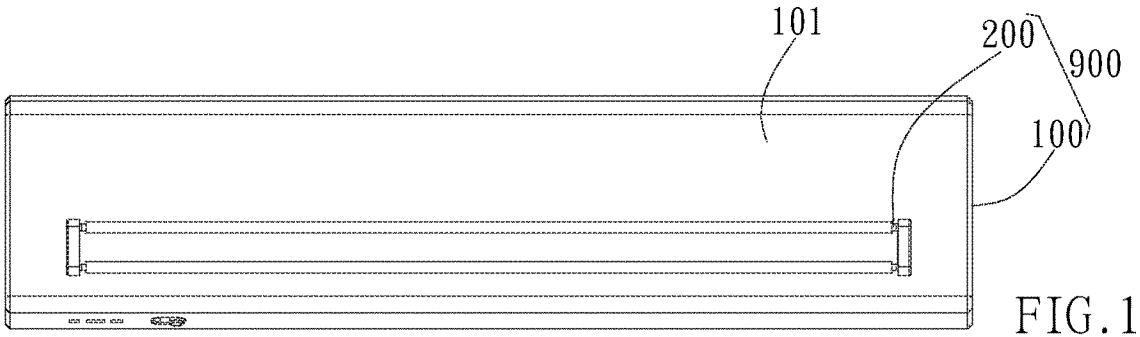
Figures 1, 1G, 2:
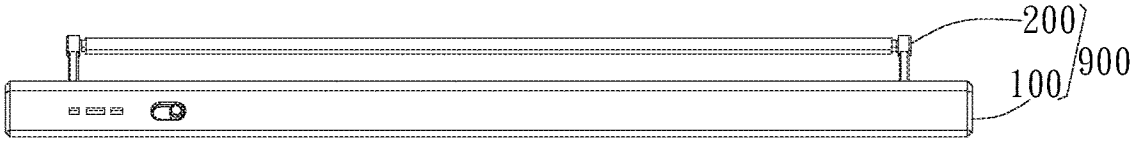
Figures 1, 1G, 2, 3, 4:
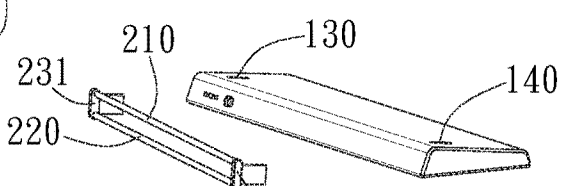
Figures 1, 1G, 2, 3:
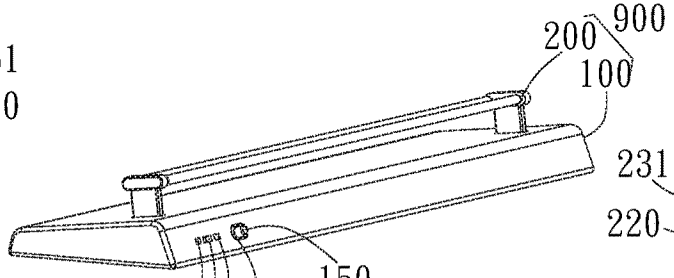
Figures 1, 1G, 2, 3, 4, 5:
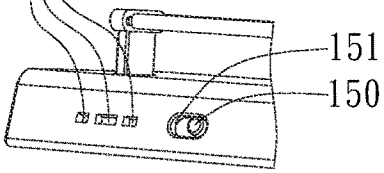
Figures 1, 1G, 2, 3, 4, 5, 6:
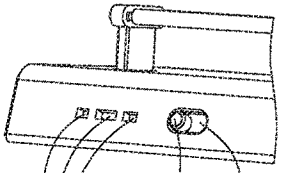

As the embodiments shown in FIGS. 1F-1 to 1F-5, in the laptop lock 900 provided by the present invention, a laptop 800 can be locked and attached to the body 100 by the fixing device 200. More particularly, the shaft 830 connecting the screen 810 and the keyboard part 820 of the laptop 800 can be arranged on the body 100 by a user, then the screen 810 is lifted to enable the screen 810 to pass through the gap between the member bars 210 and 220 of the fixing device 200 as shown in FIG. 1F-1, i.e. the fixing device 200 sleeves the screen 810, and then, the fixing parts 230 and 240 are inserted into the jacks as shown in FIG. 1F-2. Subsequently, the lock 190 is operated to be in a locked state, and then, the laptop 800 can be locked and attached to the body 100. When the lock 190 is in the locked state, the lock 190 interferes with the fixing device 200, thereby limiting movement of the fixing device 200 relative to the body 100 so as to enable the laptop to be locked and attached to the body 100. When the lock 190 is in an unlocked state, the user can press the control component 199 to release the interference of the lock 190 on the fixing device 200, thereby releasing the movement limit of the fixing device 200 relative to the body 100.

On the other hand, as the embodiments shown in FIGS. 1F-3 to 1F-5, a cord 912 can be inserted into the lock hole 110. When the lock 190 is in the locked state, the lock 190 interferes with the cord 912, thereby preventing the cord 912 from leaving the lock hole 110. When the lock 190 is in the unlocked state, the user can press the control component 199 to release the interference of the lock 190 on the cord 912, thereby releasing the movement limit of the cord 912 relative to the lock hole 110. The cord 912 can be fixed to other objects. For example, the cord 912 can be bound to a table leg.

As the embodiments shown in FIGS. 1G-1 to 1G-4, the laptop lock 900 provided by the present invention includes a body 100 and a fixing device 200. As the embodiments shown in FIGS. 1G-a to 1G-4, the body 100 is provided with a support surface 101, and the support surface 101 is provided with jacks 130 and 140 at two opposite ends of the support surface 101 close to the body 100. The fixing device 200 includes member bars 210 and 220, and a gap is formed between the member bars 210 and 220, where the member bars 210 and 220 are connected by connecting parts 231 and 241, and the connecting parts 231 and 241 can be respectively inserted into the jacks 130 and 140.

More particularly, as the embodiment shown in FIG. 1G-4, the connecting parts 231 and 241 are insertion pieces. As the embodiments shown in FIGS. 1G-5 and 1G-6, the body 100 includes a lock hole 110 and a shielding plate 151, and the shielding plate 151 can be operated by a shielding plate operating button 150 to move so as to enable the lock hole 110 to be shielded (referring to FIG. 1G-5) or exposed (referring to FIG. 1G-6). In order to adapt to different locksets and increase use convenience, a plurality of lock holes 110 can be provided and have different sizes, such as 3.2 mm×4.5 mm or 3 mm×7 mm or 2.5 mm×5.5 mm.

Figures 1, 2A:
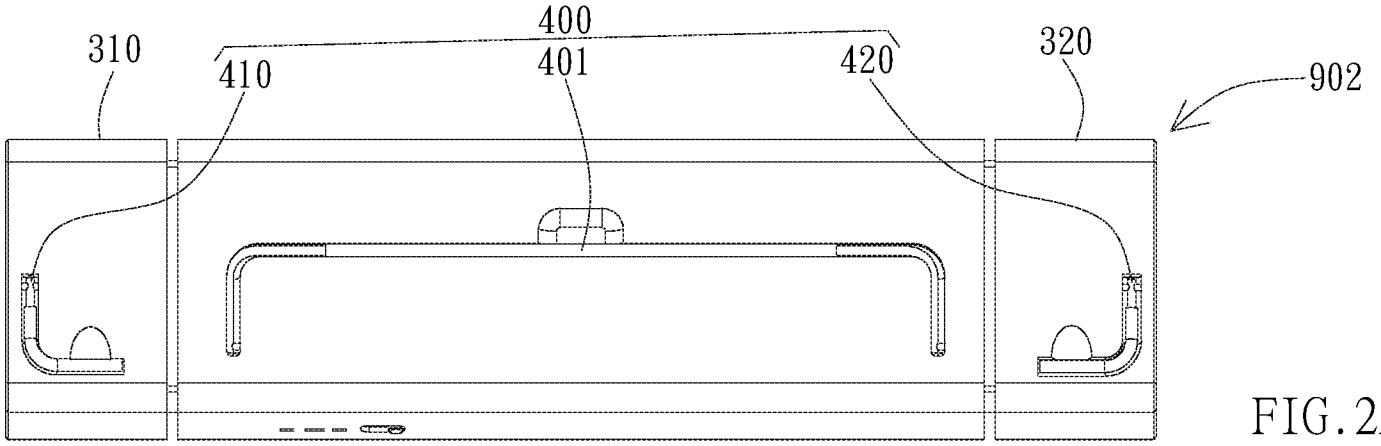
Figures 2, 2A:
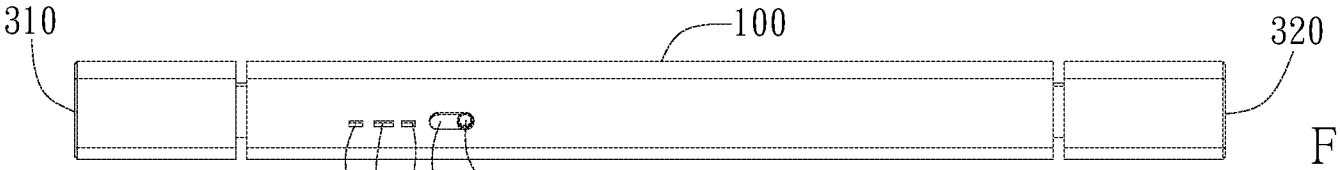
Figures 1, 2B:
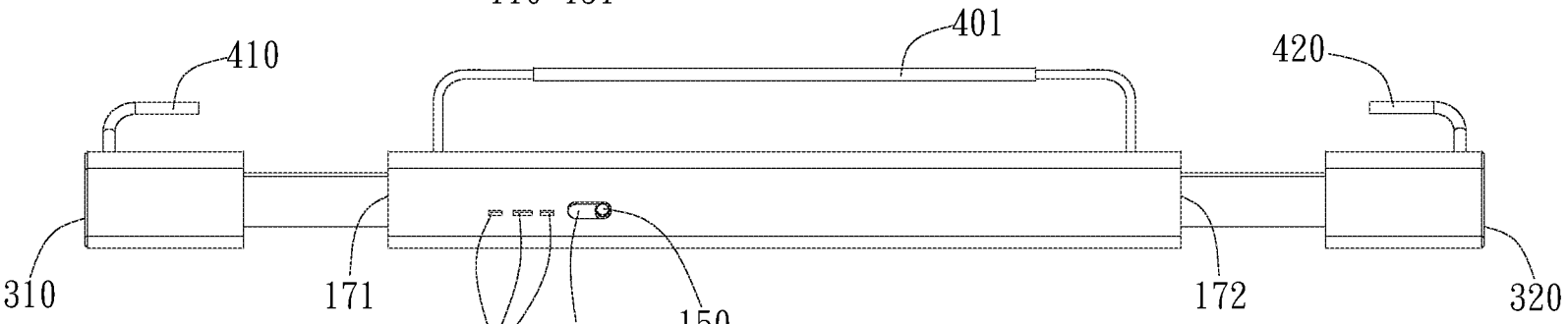
Figures 2, 2B:
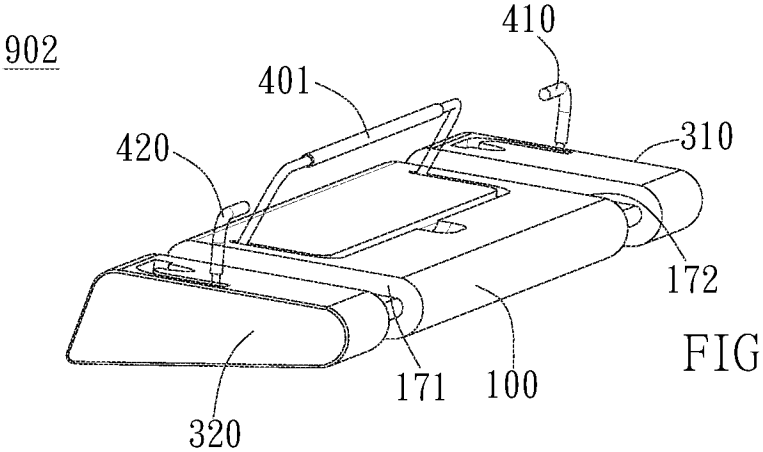
Figures 2, 2B, 3, 4:
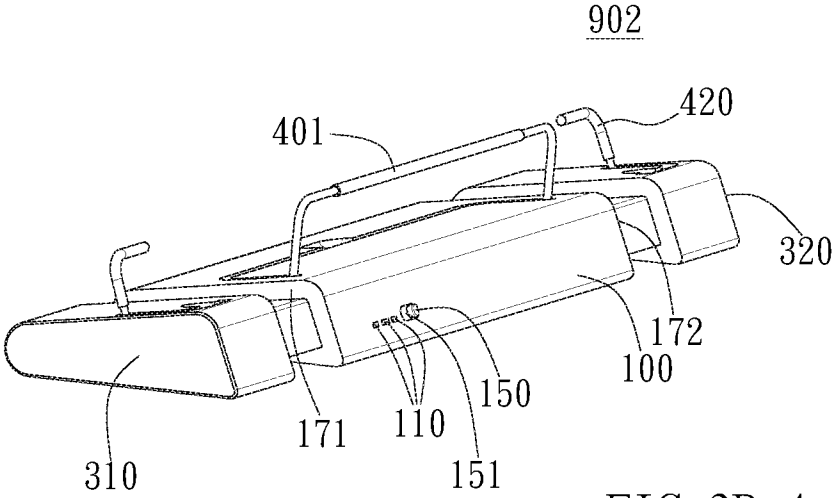
Figures 2, 2B, 3:
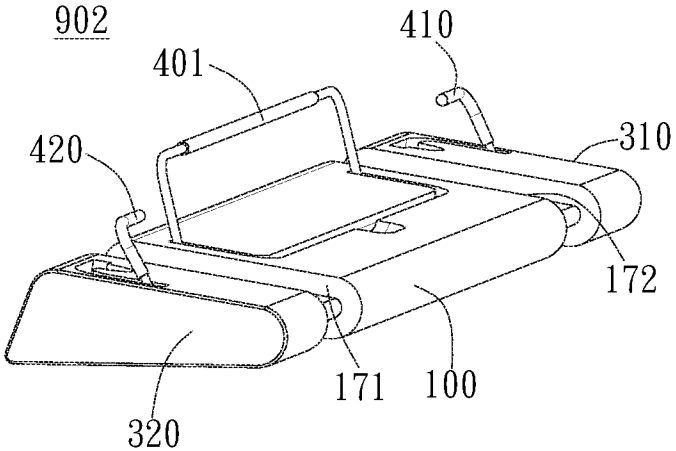
Figures 2, 2B, 3, 4, 5:
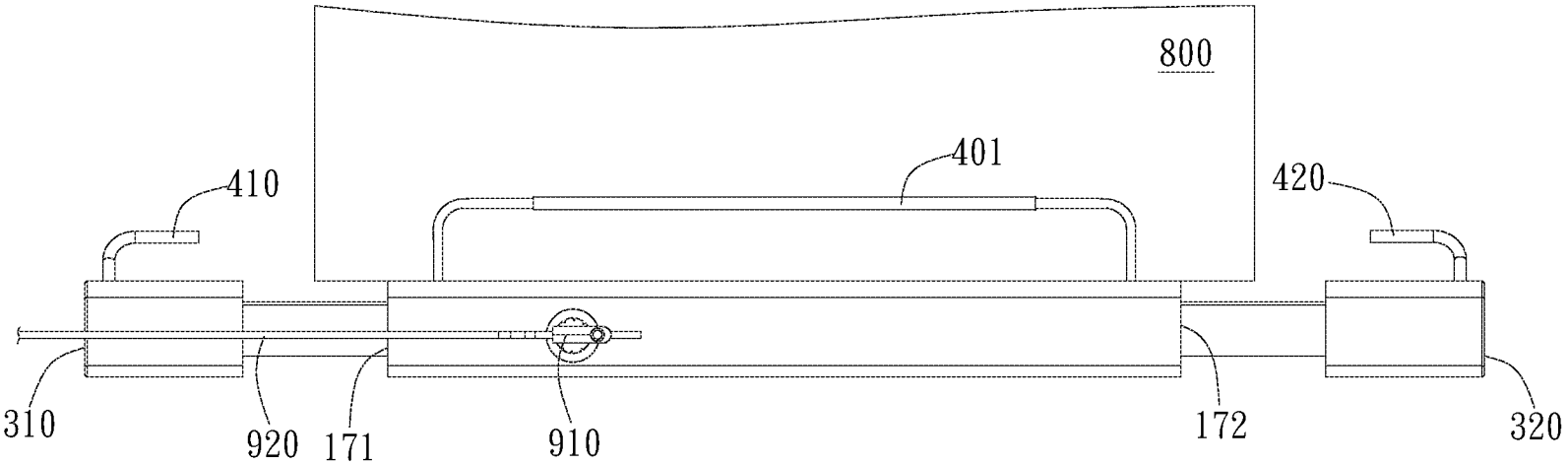
Figures 2, 2B, 3, 4, 5, 6:
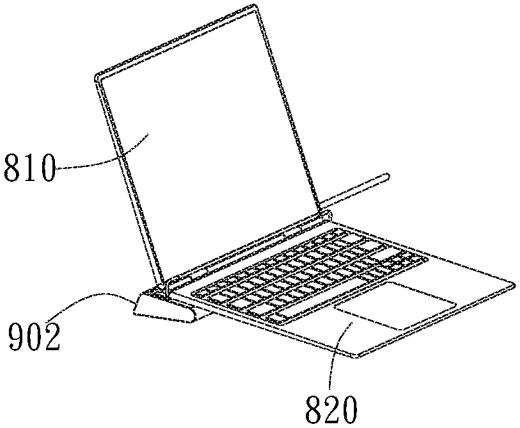
Figure 2C:
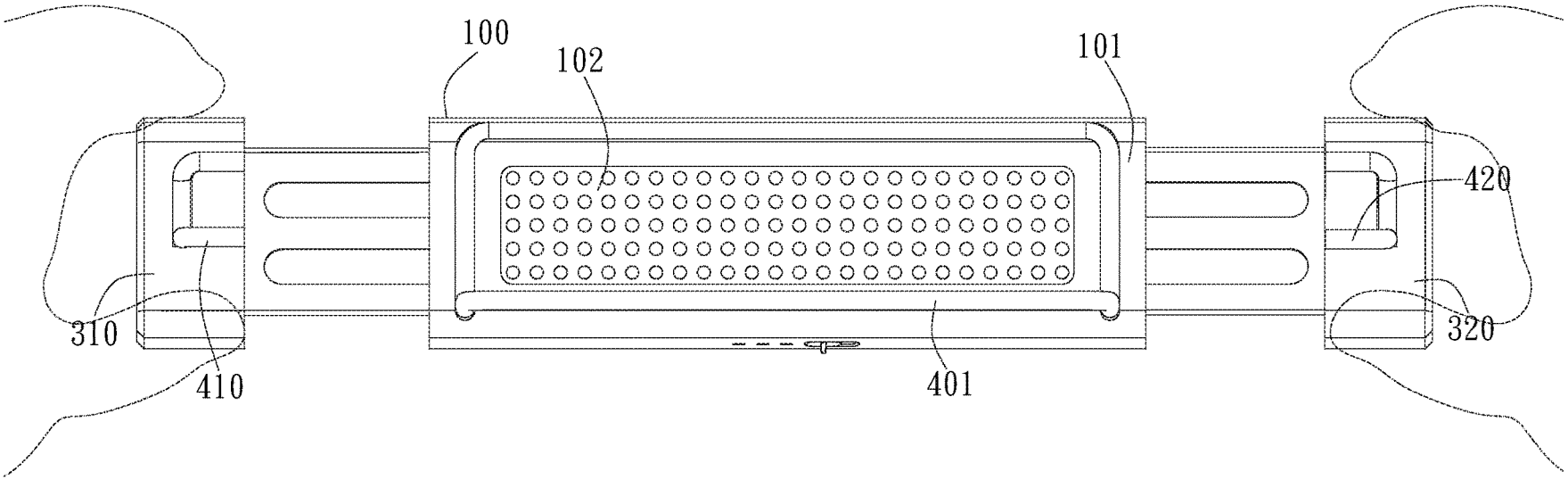
Figure 2D:
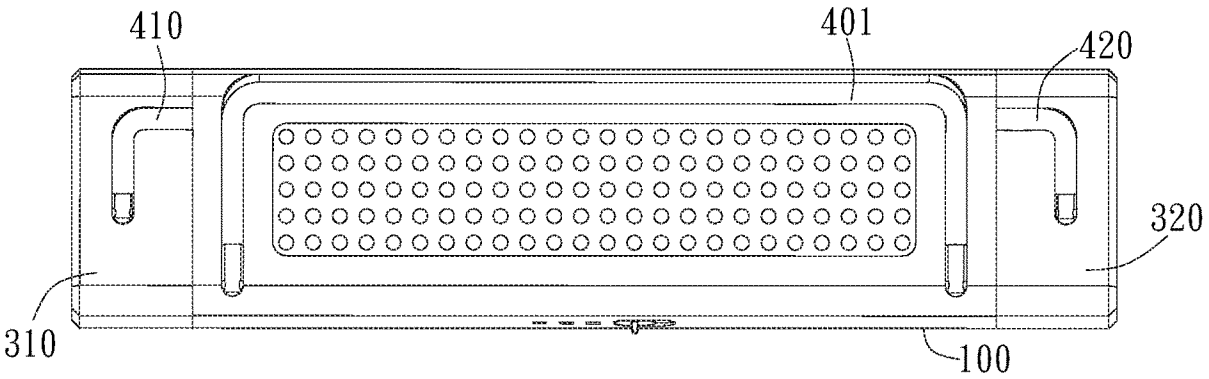
Figure 2E:
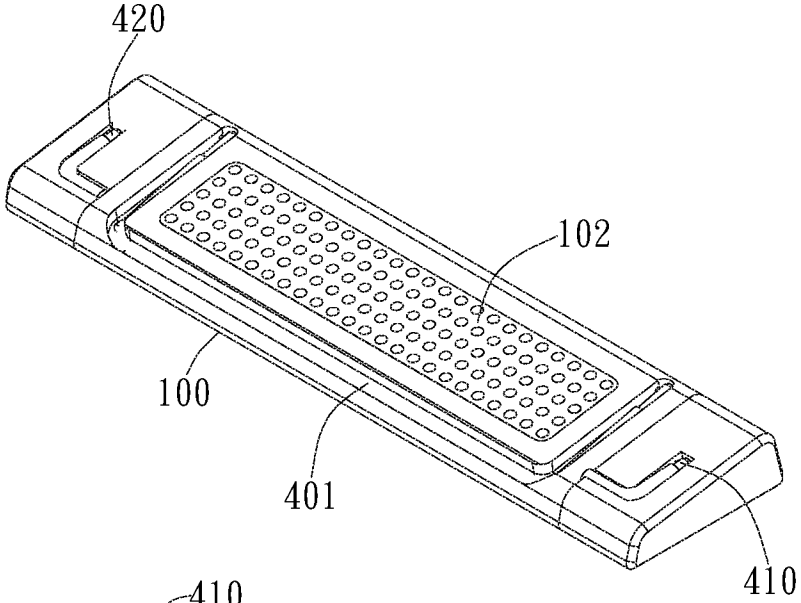
Figure 2F:
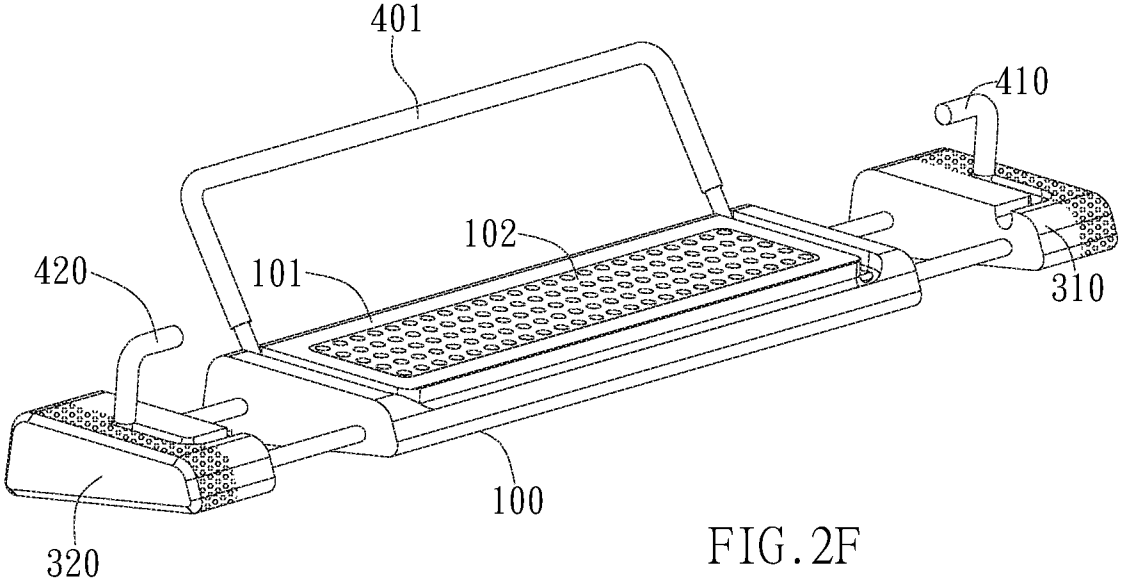

As the embodiments shown in FIGS. 2A-1 to 2A-2, a laptop lock 901 provided by the present invention includes a body 100, a first support arm 310, a second support arm 320 and a fixing device 400. The first support arm 310 and the second support arm 320 can move outwards relative to two ends 171 and 172 of the body 100. The fixing device 400 includes a support unit 401 which is arranged on a support surface 101 of the body 100 and a first limiting unit 410 and a second limiting unit 420 which are respectively arranged on surfaces of the first support arm 310 and the second support arm 320, where the support unit 401 can be rotationally lifted relative to the support surface 101, and the first limiting unit 410 and the second limiting unit 420 can be rotationally lifted relative to the support surface 101 and along a direction opposite to a rotation direction of the support unit 401. The body 100 further includes a lock hole 110 and a shielding plate 151, and the shielding plate 151 can be operated by a shielding plate operating button 150 to move so as to enable the lock hole 110 to be shielded or exposed. In order to adapt to different locksets and increase use convenience, a plurality of lock holes 110 can be provided and have different sizes, such as 3.2 mm×4.5 mm or 3 mm×7 mm or 2.5 mm×5.5 mm.

As the embodiments shown in FIGS. 2B-1 to 2B-6, the laptop lock 902 provided by the present invention can be used together with a lockset 910, and a laptop 800 is locked and attached to the body 100 by virtue of the first support arm 310, the second support arm 320, and the fixing device 400. Further, a user can take out the laptop lock 900 firstly, the first support arm 310 and the second support arm 320 are moved outwards relative to two ends 171 and 172 of the body 100 as shown in FIGS. 2B-2 to 2B-4, the support unit 401, the first limiting unit 410, and the second limiting unit 420 are lifted, then the shaft 830 connecting the screen 810 and the keyboard part 820 of the laptop 800 is arranged on the body 100, the screen 810 is lifted, then the first support arm 310 and the second support arm 320 are moved inwards relative to the two ends of the body 100, and thus, the screen 810 is positioned between the support unit 401, the first limiting unit 410, and the second limiting unit 420. Subsequently, the shielding plate operating button 150 is used for moving the shielding plate 151 to expose the lock hole 110, the lockset 910 is inserted into the lock hole 110 to enable the lockset 910 to be in a locked state, and then, the laptop 800 can be locked and attached to the body 100 as shown in FIG. 2B-5.

More specifically, when the lockset 910 is inserted into the lock hole 110, the lockset 910 interferes with the first support arm 310 and the second support arm 320, thereby limiting movement of the first support arm 310 and the second support arm 320 relative to the body 100, and further limiting movement of the screen 810 relative to the body 100 by virtue of the first limiting unit 410 and the second limiting unit 420. Because a rotation direction of the support unit 401 is opposite to a rotation direction of the first limiting unit 410 and the rotation direction of the second limiting unit 420, the support unit 401, the first limiting unit 410, and the second limiting unit 420 substantially form a clamp together to limit rotation of the screen 810 relative to the body 100 so as to enable the laptop to be locked and attached to the body 100. The lockset 910 can include a cord 912 for being fixed to other objects. For example, the cord 912 can be bound to a table leg. Surfaces of the support unit 401, the first limiting unit 410, and the second limiting unit 420 can be covered with soft substances such as rubber so as to prevent the laptop 800 from being damaged.

Further, the lockset 910 interferes with the first support arm 310 and the second support arm 320, thereby limiting the movement of the first support arm 310 and the second support arm 320 relative to the body 100, and further limiting the movement of the screen 810 relative to the body 100 by the first limiting unit 410 and the second limiting unit 420 so as to basically lock and fix the laptop 800 to the body 100. In different embodiments, the rotation direction of the support unit 401 is not limited to being opposite to the rotation direction of the first limiting unit 410 and the rotation direction of the second limiting unit 420, as long as the screen 810 can be contained therebetween.

Figures 1, 2G:
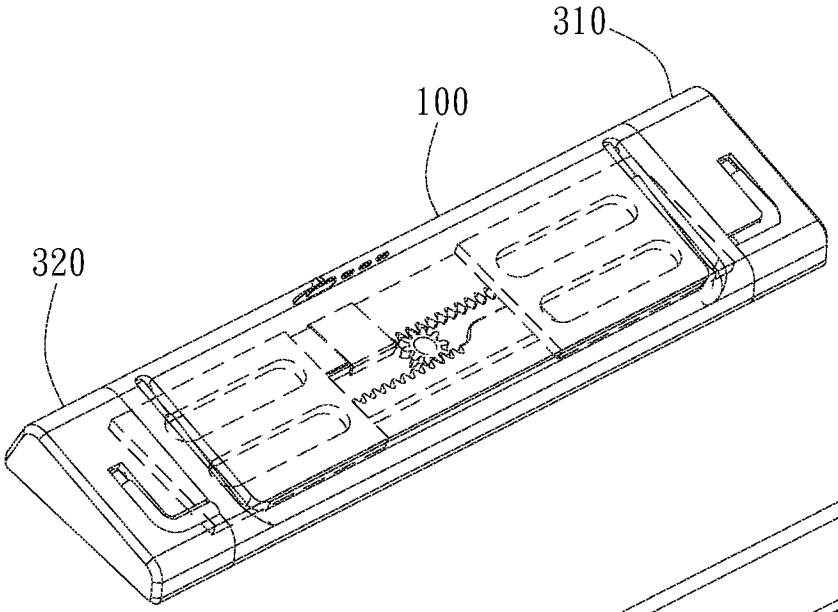
Figures 2, 2G:
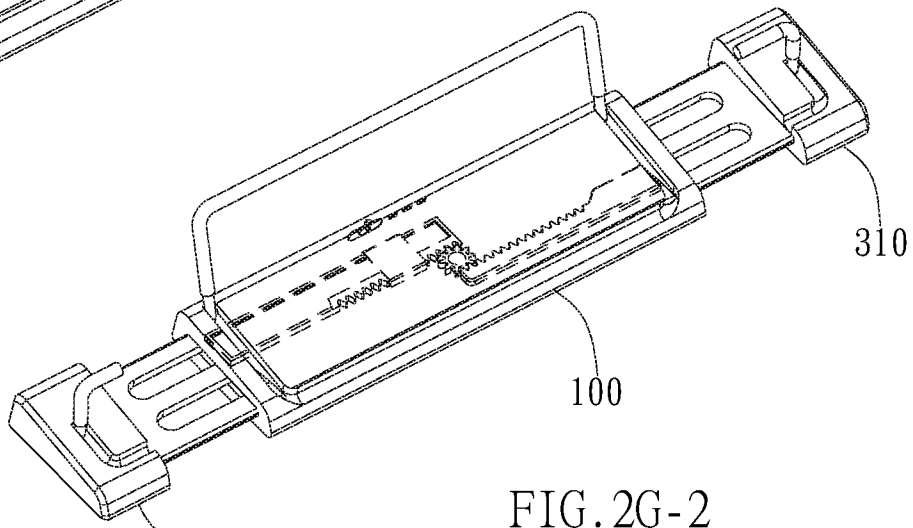
Figure 2H:
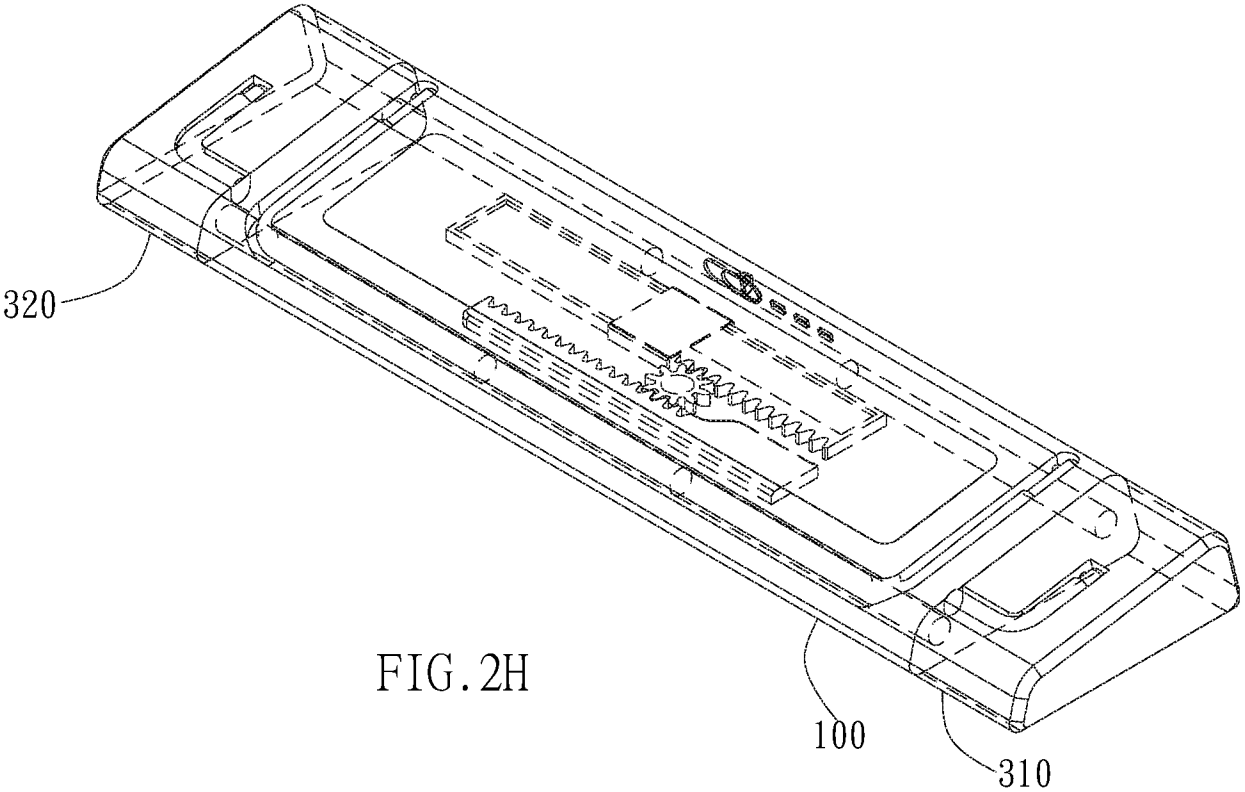
Figures 1, 2I:
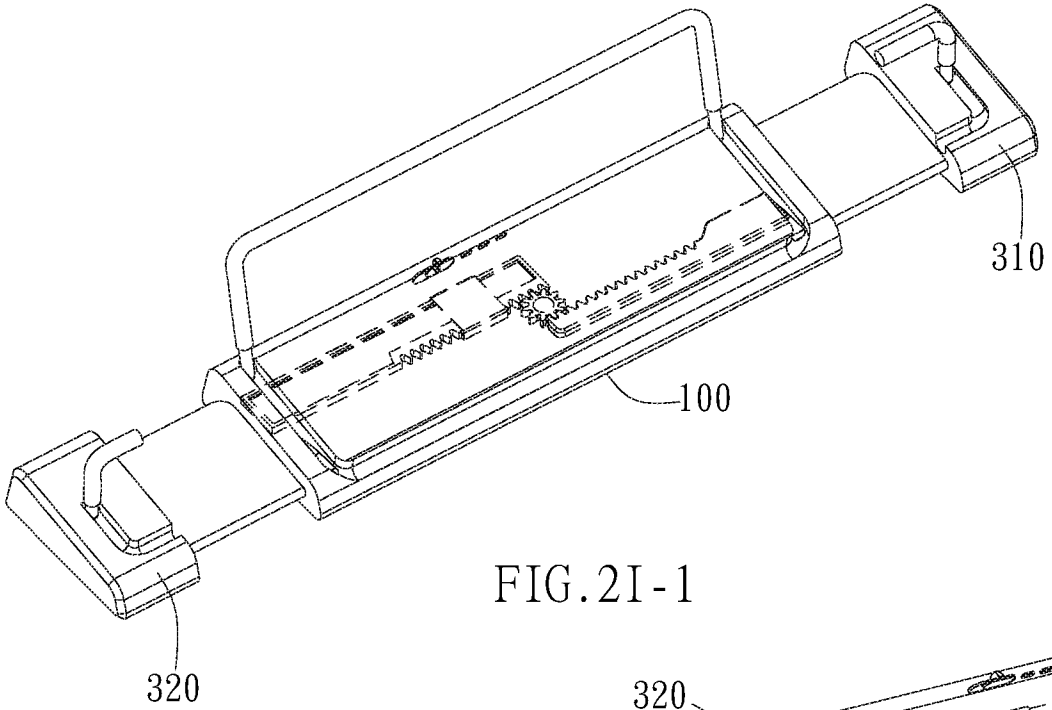
Figures 2, 2I:
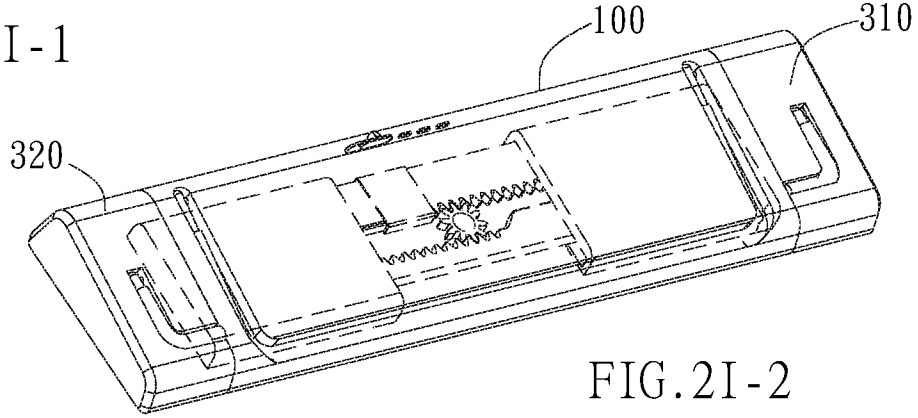
Figures 1, 2, 2J:
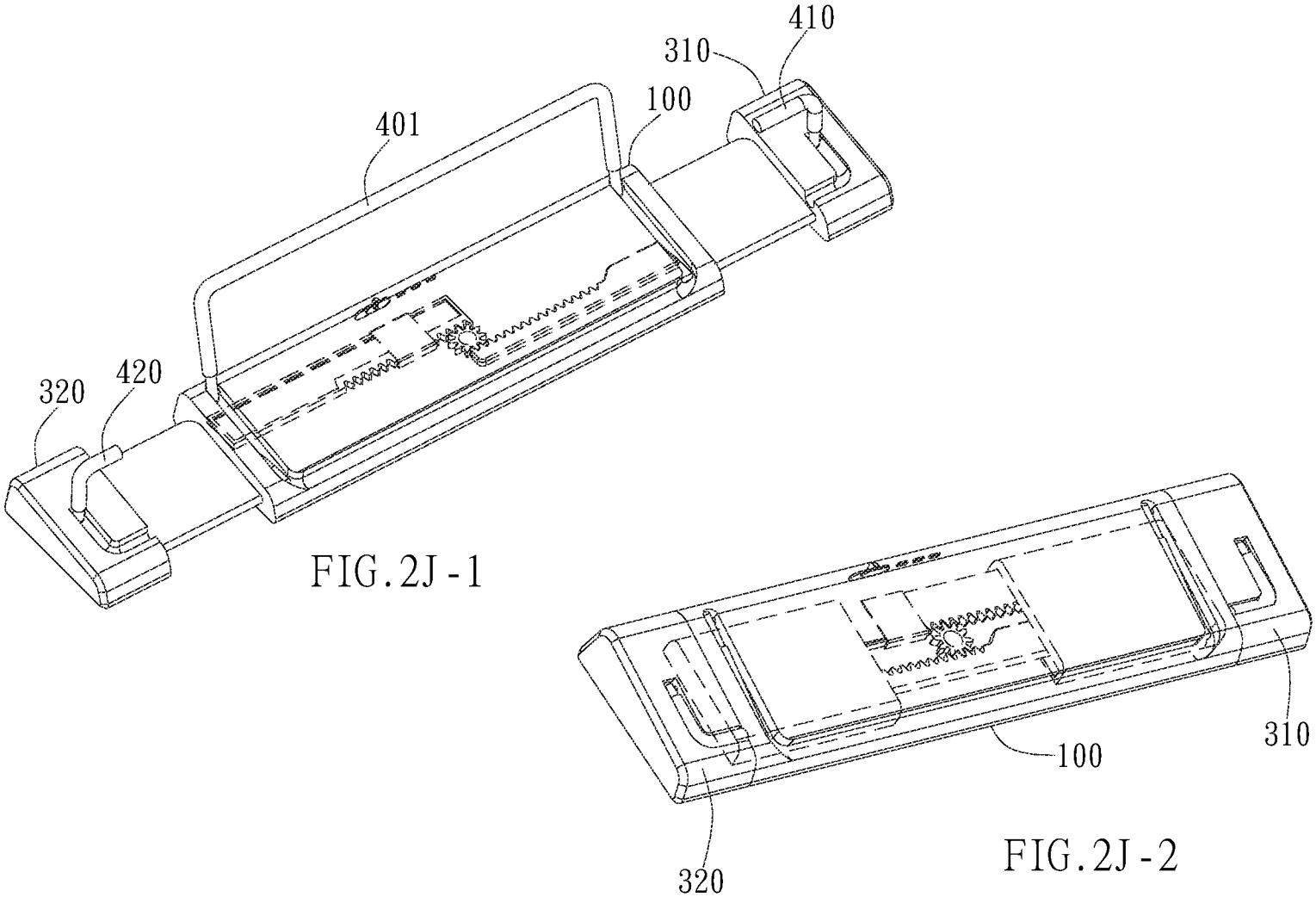
Figure 2L:
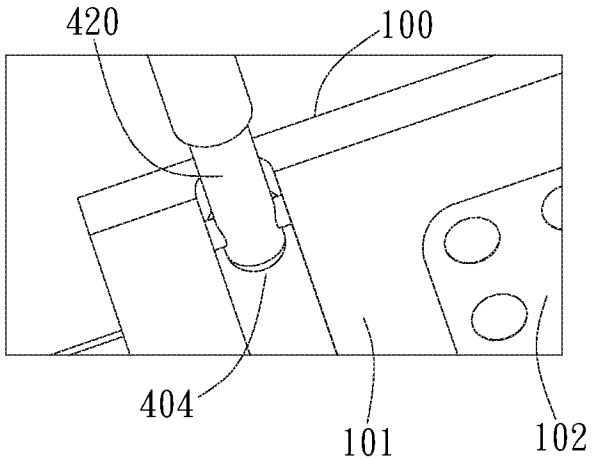
FIG. 2L is perspective view of embodiment of a dent in the invention.
Figure 2K:
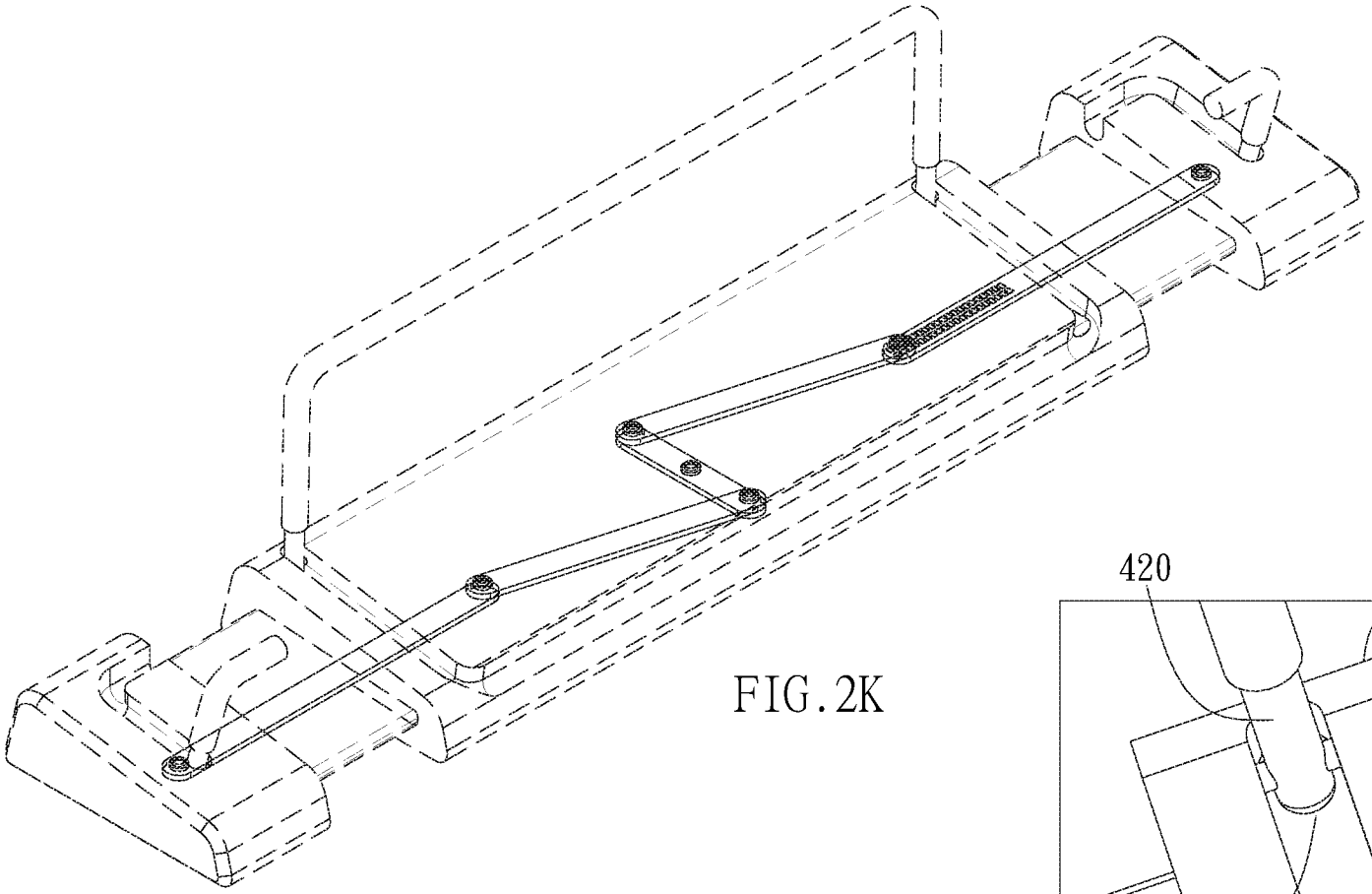

On the other hand, according to embodiments shown in FIGS. 2C to 2F, the support surface 101 of the body 100 is also provided with a gasket 102 so as to increase the friction force and reduce damage caused by collision. The relative movement of the first support arm 310 and the second support arm 320 with respect to the body 100 can be achieved by the mechanisms shown in FIGS. 2G-1 to 2K. As the embodiment shown in FIG. 2L, the joint positions of the support unit 401, the first limiting unit 410, and the second limiting unit 420 and the body 100, the first support arm 310, and the second support arm 320 can be provided with dents 404 for clamping and fixing the support unit 401, the first limiting unit 410, and the second limiting unit 420 when the support unit 401, the first limiting unit 410, and the second limiting unit 420 are lifted.

Figure 3A:
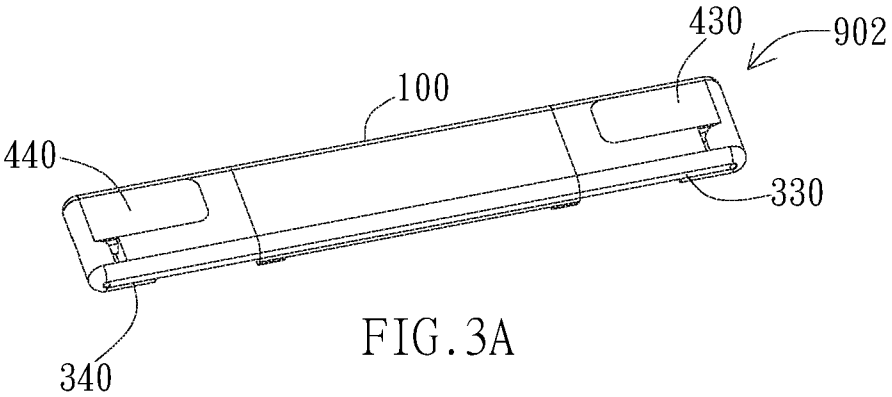

As the embodiment shown in FIG. 3A, a laptop lock 902 provided by the present invention includes a body 100, a first support arm 330, a second support arm 340, and a fixing device 400. As the embodiment shown in FIG. 3B-1, the first support arm 330 and the second support arm 340 can move outwards relative to two ends of the body 100. The fixing device 400 includes a first limiting unit 430 and a second limiting unit 440 which are respectively arranged on surfaces of the first support arm 330 and the second support arm 340, where the first limiting unit 430 and the second limiting unit 440 can be rotationally lifted relative to a support surface 101.

Figures 1, 3B:
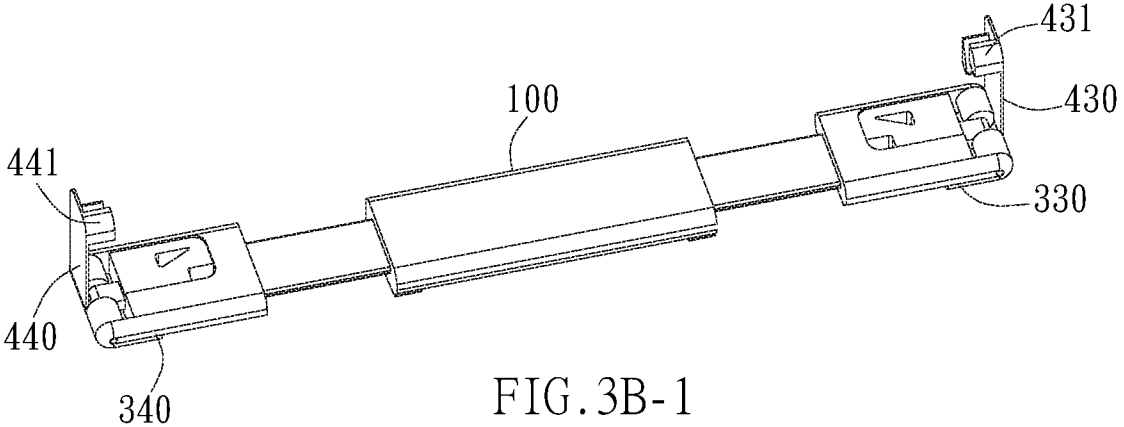
Figures 2, 3B:
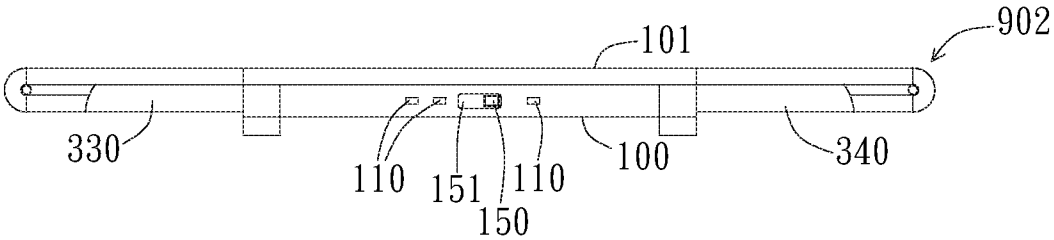

As the embodiment shown in FIG. 3B-2, the body 100 further includes a lock hole 110 and a shielding plate 151, and the shielding plate 151 can be operated by a shielding plate operating button 150 to move so as to enable the lock hole 110 to be shielded or exposed. In order to adapt to different locksets and increase use convenience, a plurality of lock holes 110 can be provided and have different sizes, such as 3.2 mm×4.5 mm or 3 mm×7 mm or 2.5 mm×5.5 mm.

Figure 3C:
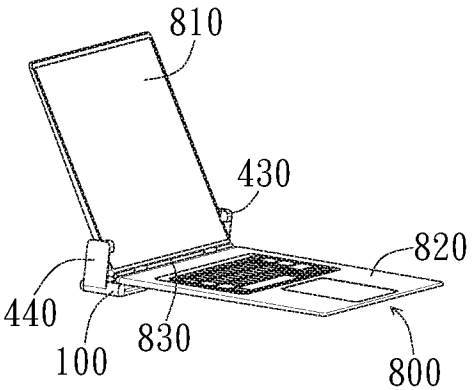
Figure 3D:
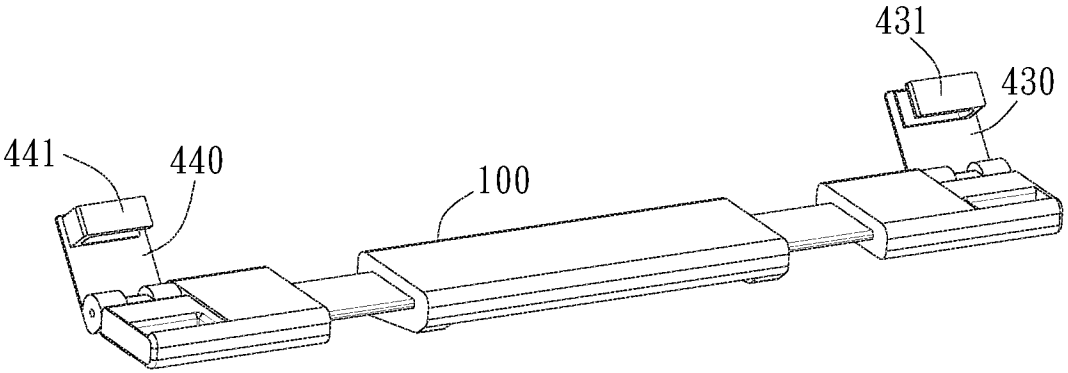
Figure 3E:
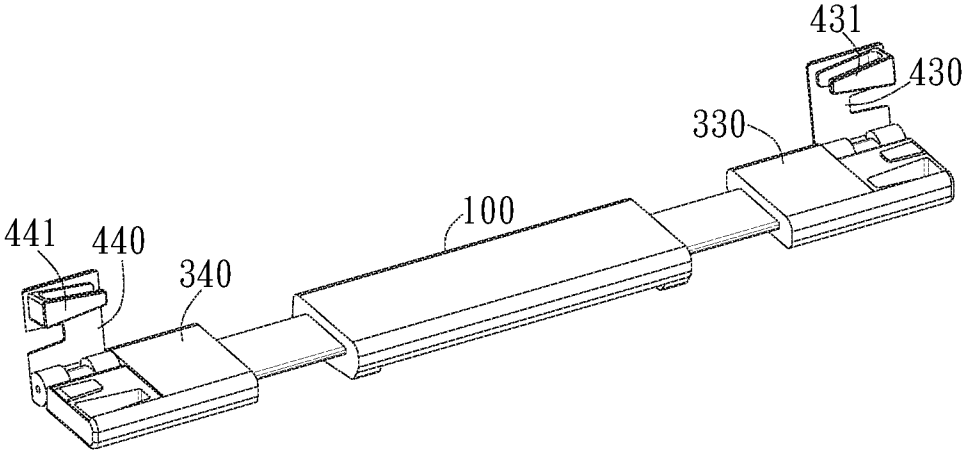
Figures 1, 3F:
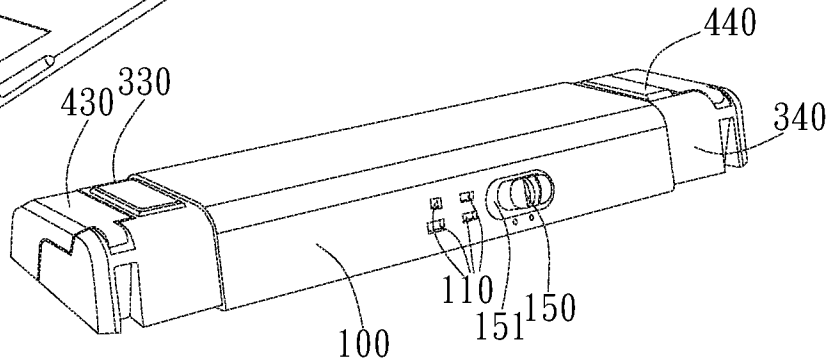
Figures 2, 3F:
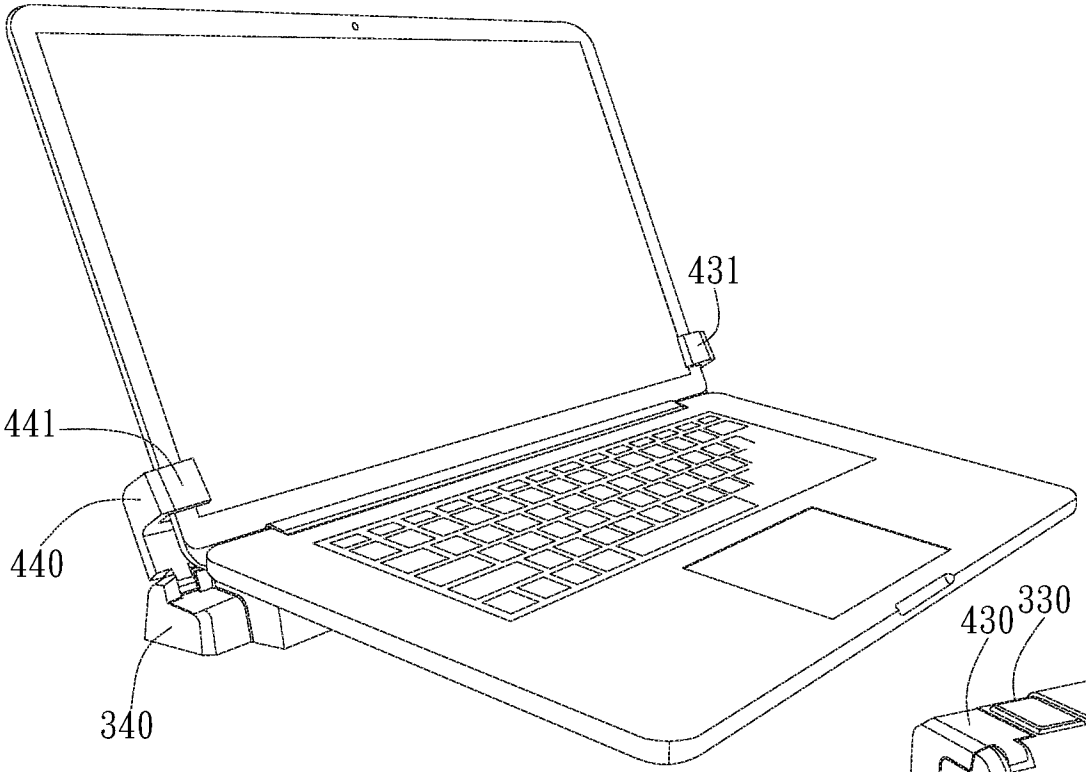
Figure 3G:
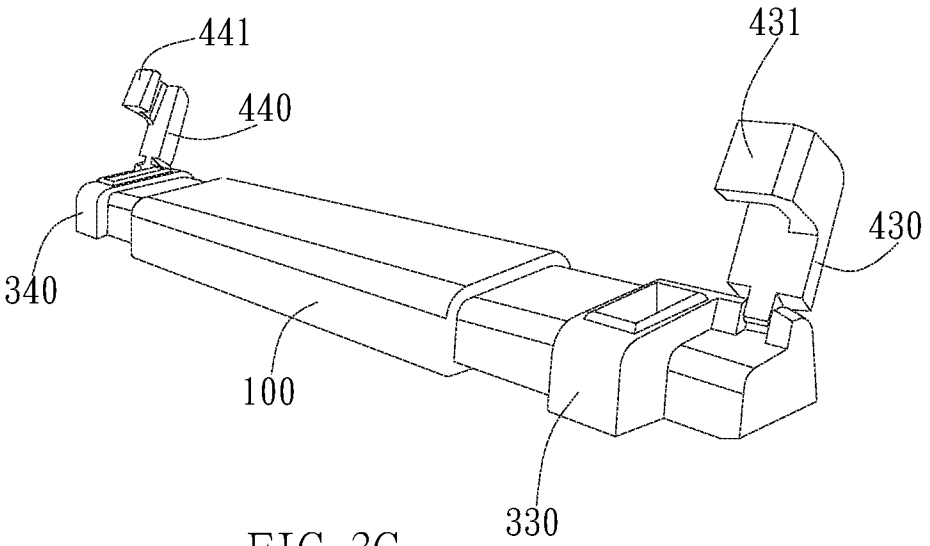
Figure 3H:
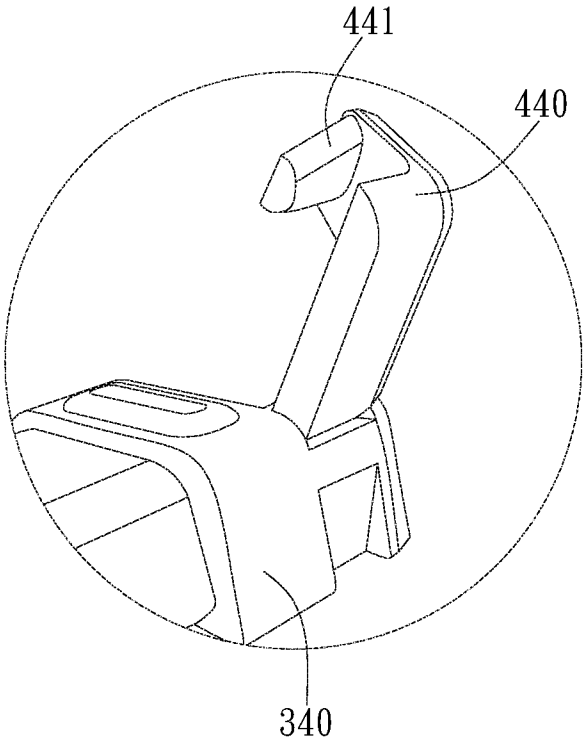

The laptop lock 902 provided by the present invention can be used together with a lockset 910, and a laptop 800 is locked and attached to the body 100 by virtue of the first support arm 330, the second support arm 340 and the fixing device 400. According to an embodiment shown in FIG. 3B, the first limiting unit 430 and the second limiting unit 440 are respectively provided with a first limiting part 431 and a second limiting part 441, and the first limiting part 431 and the second limiting part 441 are preferably, but not limited to, grooves. During use, a user can take out the laptop lock 902 firstly, the first limiting unit 430 and the second limiting unit 440 are lifted, the first support arm 330 and the second support arm 340 are moved outwards relative to two ends of the body 100 (or the first support arm 330 and the second support arm 340 can be pulled firstly, and then the first limiting unit 430 and the second limiting unit 440 are lifted), then the shaft 830 connecting the screen 810 and the keyboard part 820 of the laptop 800 is arranged on the body 100 as shown in FIG. 3C, the screen 810 is lifted, then the first support arm 330 and the second support arm 340 are moved inwards relative to the two ends of the body 100 as shown in FIG. 3B-1, the screen 810 is positioned between the first limiting unit 430 and the second limiting unit 440, and edges of the screen 810 are clamped into the first limiting part 431 and the second limiting part 441. Subsequently, the shielding plate operating button 150 is used for moving the shielding plate 151 to expose the lock hole 110, the lockset 910 is inserted into the lock hole 110 (referring to FIG. 3B-2) to enable the lockset 910 to be in a locked state, and then, the laptop 800 can be locked and attached to the body 100.

More specifically, when the lockset 910 is inserted into the lock hole 110, the lockset 910 interferes with the first support arm 330 and the second support arm 340, thereby limiting movement of the first support arm 330 and the second support arm 340 relative to the body 100, and further limiting movement of the screen 810 relative to the body 100 by virtue of the first limiting unit 430 and the second limiting unit 440. The edges of the screen 810 are clamped into the first limiting part 431 and the second limiting part 441, thereby limiting rotation of the screen 810 relative to the body 100 so as to enable the laptop to be locked and attached to the body 100. Surfaces of the first limiting unit 430 and the second limiting unit 440 and the support surface 101 can be covered with soft substances such as rubber so as to prevent the laptop 800 from being damaged.

On the other hand, as the different embodiments shown in FIG. 3D to 3H, the first limiting unit 430, the second limiting unit 440, the first limiting part 431, and the second limiting part 441 can have different settings according to manufacture or design requirements. Surfaces of the support unit 401, the first limiting unit 410, and the second limiting unit 420 can be covered with soft substances such as rubber so as to prevent the laptop 800 from being damaged. The support surface 101 can be provided with a gasket so as to increase the friction force and reduce the damage caused by collision.

Figure 4A:
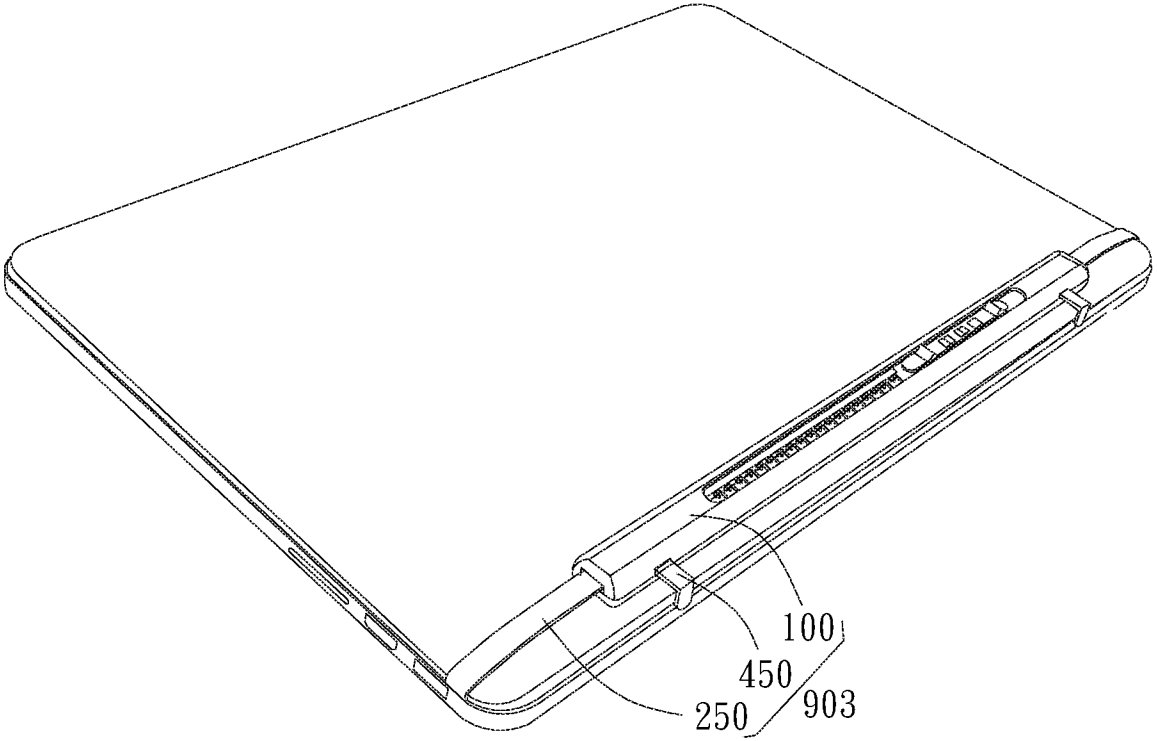
Figures 2, 4B:
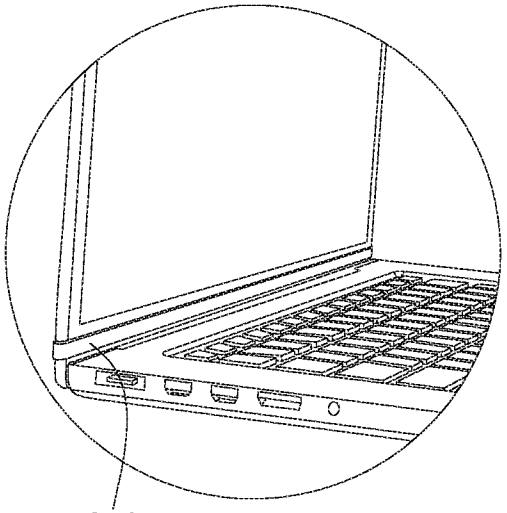
Figures 4, 4B:
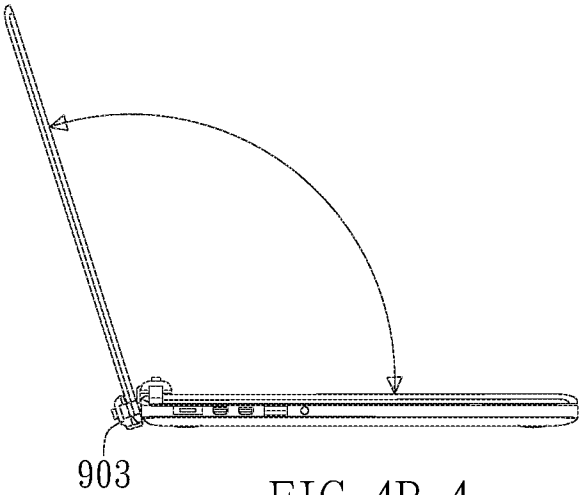
Figures 1, 4B:
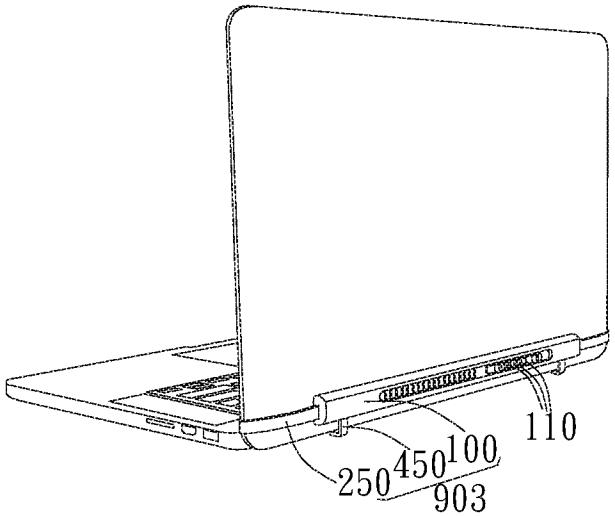
Figures 3, 4B:
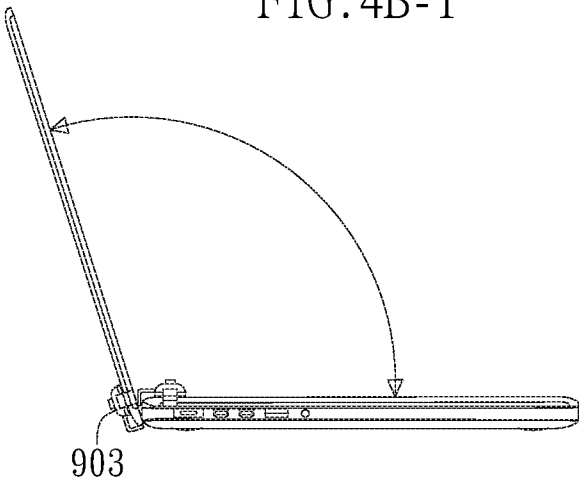
Figure 4C:
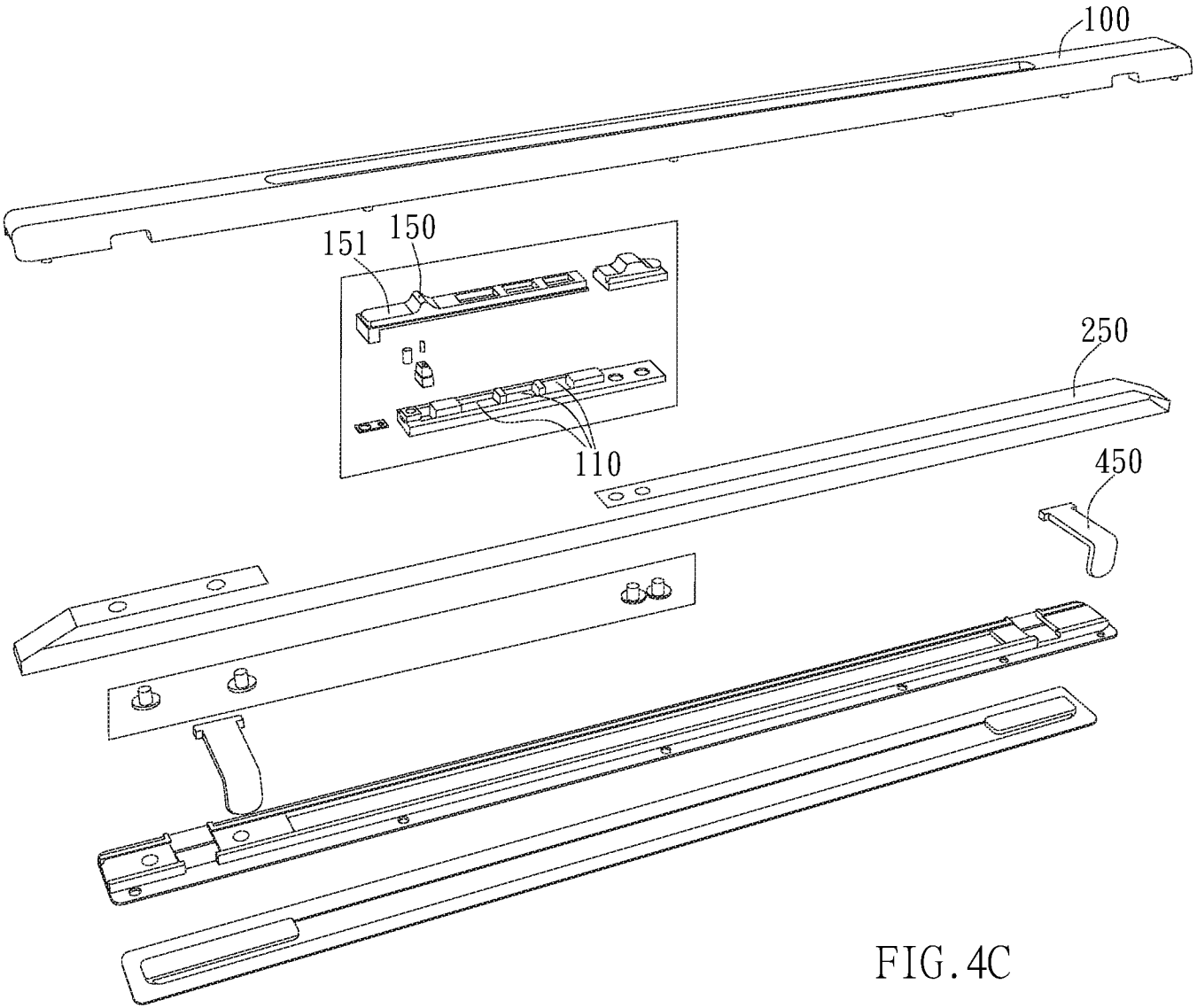
Figure 4D:
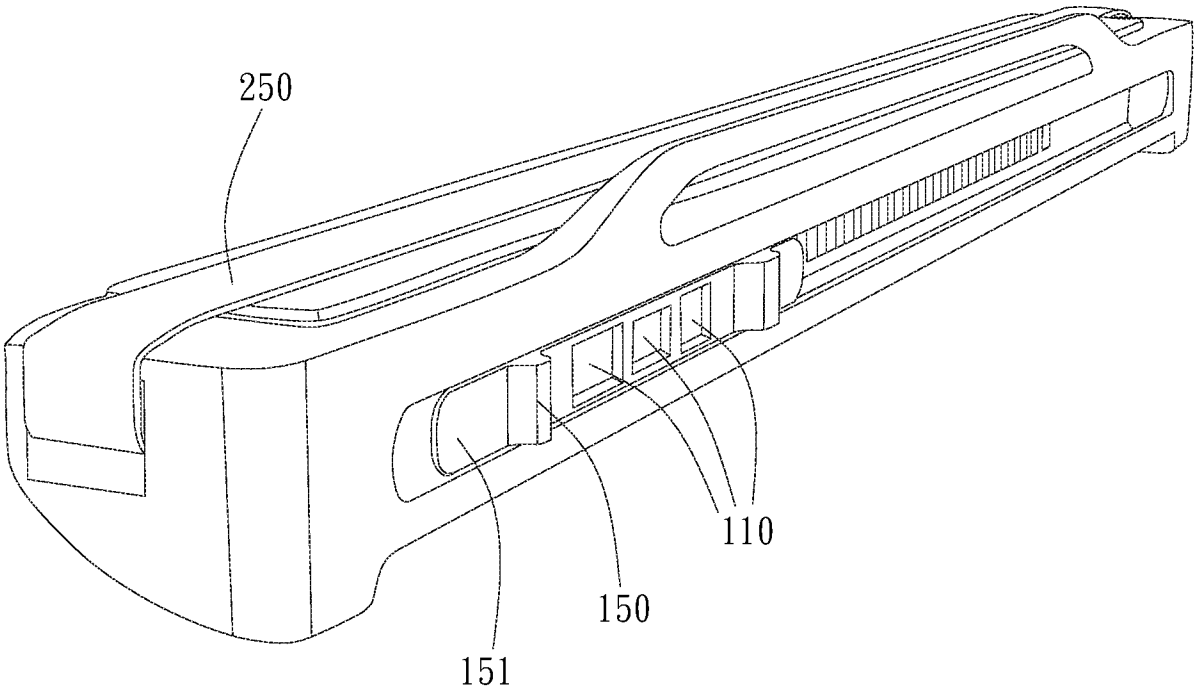
Figures 2, 4E:
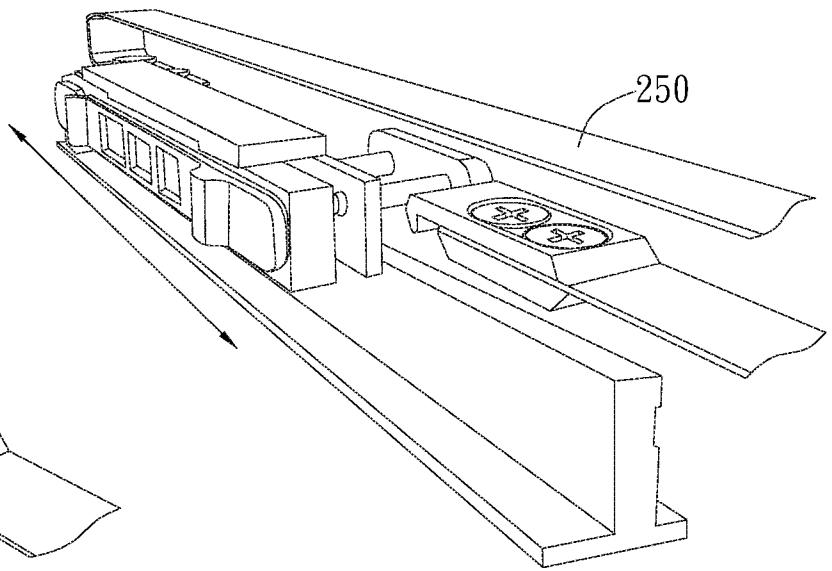
Figures 1, 4E:
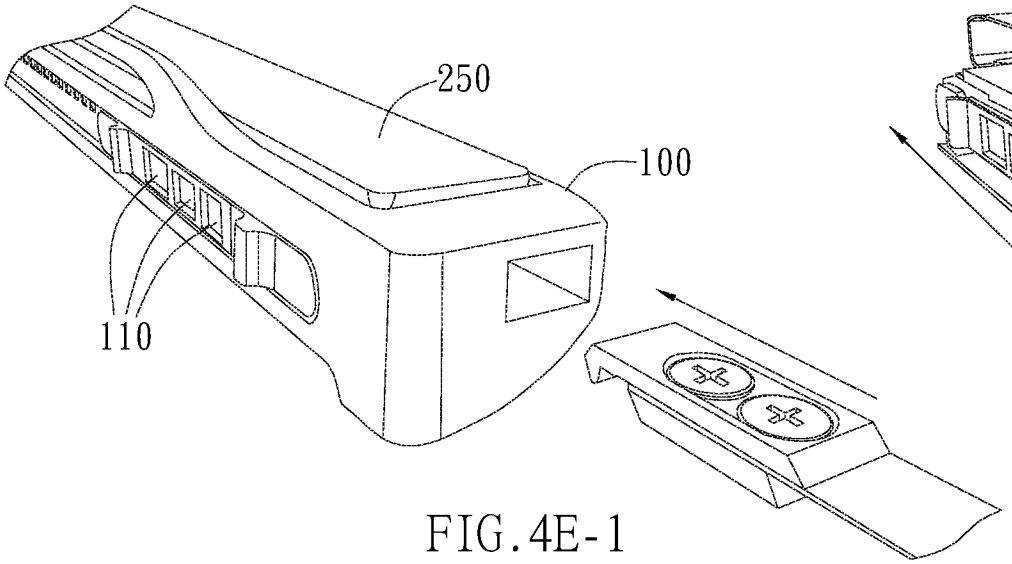
Figures 3, 4E:
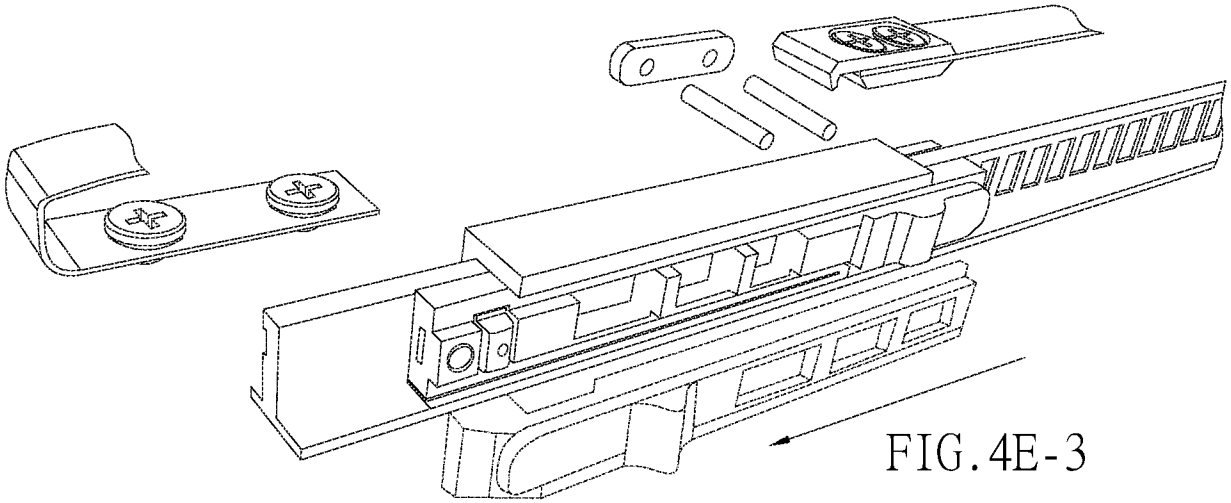
Figures 2, 4F:
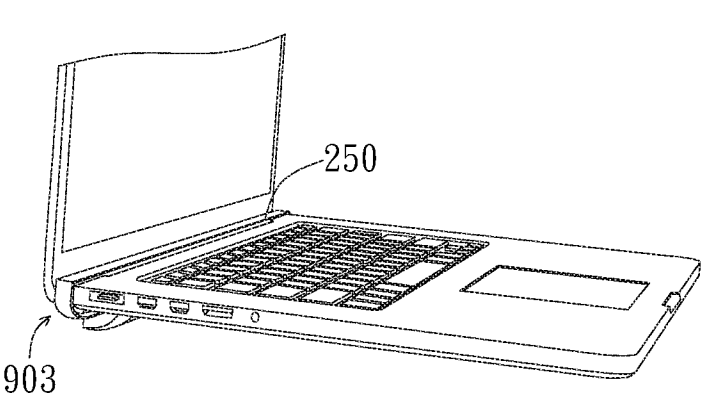
Figures 4, 4F:
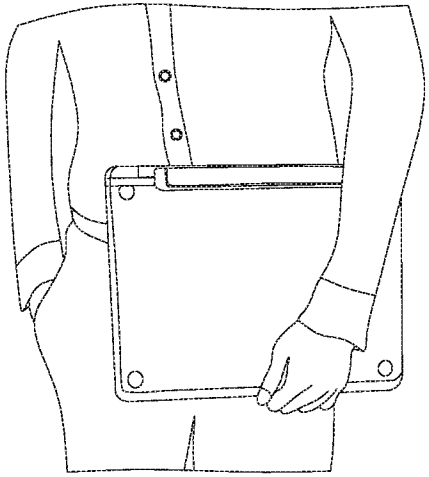
Figures 1, 4F:
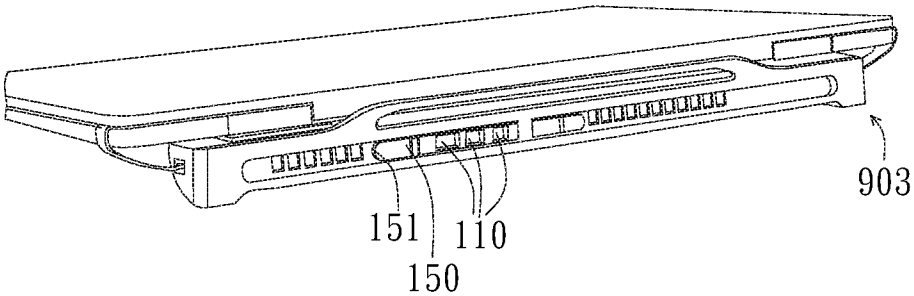
Figures 3, 4F:
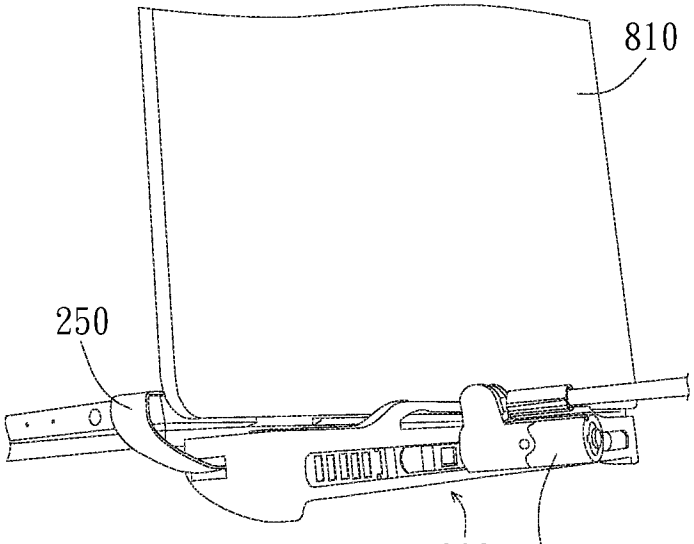

As the embodiments shown in FIGS. 4A to 4F-4, a laptop lock 903 provided by the present invention includes a body 100 and a fixing device 250. One side surface of the body 100 is provided with a lock hole 110. As the embodiment shown in FIG. 4A, the fixing device 250 extends from one end of the body 100 and can be inserted into and fixed at the other end of the body 100. More specifically, as the embodiments shown in FIGS. 4B-1 to 4B-2, when in use, the body 100 is arranged at a position that is on a back surface of a screen 810 of a laptop 800 and that is close to a pivot, the lock hole 110 faces outwards, the fixing device 250 extending from one end of the body 100 bypasses the screen 810 and is inserted into and fixed at the other end of the body 100, and the screen 810 is positioned between the fixing device 250 and the body 100, thereby completing fixation between the laptop lock 903 and the laptop 800. In this case, a lockset can be locked and attached to the lock hole 110 by a user as shown in FIG. 4F-3. Because the lockset is locked and attached to the lock hole 110 of the laptop lock 903 and the material and size of the body 100 of the laptop lock 903 can be changed according to design or usage requirements, a case of inability of locking and attaching caused by limits of the laptop (for example, the lock hole can not be arranged due to an excessive thin host or insufficient material strength) can be reduced. The body 100 further includes a shielding plate operating button 150 and a shielding plate 151, and the shielding plate 151 can be operated by the shielding plate operating button 150 to move so as to enable the lock hole 110 to be shielded or exposed. As the embodiment shown in FIG. 4F-1, the body 100 further includes a heat dissipation block capable of increasing a heat dissipation effect.

As the embodiments shown in FIGS. 5A to 5J, a laptop lock 904 provided by the present invention includes a body 100, a first support arm 360, and a fixing device 260. The first support arm 360 is provided with a control button 160. One end surface of the first support arm 360 is provided with a lock hole 110. As the embodiments shown in FIGS. 5A to 5C, a user can press the control button 160 to release movement limit of the first support arm 360 relative to the body 100, so that the first support arm 360 can extend from one end of the body 100 along the long axial direction 141 of the body 100.

As the different embodiments shown in FIGS. 5D-1 to 5E-2, the first support arm 360 can extend out of an end of the body 100 along a long axial direction 141 of the body 100. The first support arm 360 includes a lock hole disposed at the end portion of the first support arm 360 and a support arm extending part 366 extends along the direction perpendicular to the long axial direction 141 of the body 100. The fixing device 260 extends from one end of the support arm extending part 366 and can be fixed at one end of the body 100. More specifically, the user can take out the laptop lock 904 firstly, press the control button 160, move the first support arm 360 outwards relative to the end of the body 100 to enable the length of the body 100 and the length of the first support arm 360 extending from the body 100 to be approximately equal to the width of a laptop 800, then the shaft 830 connecting the screen 810 and the keyboard part 820 of the laptop 800 is arranged on the body 100, the screen 810 is lifted, the fixing device 260 extending from one end of the first support arm 360 bypasses the laptop 800 and is fixed at one end of the body 100, and the laptop 800 is positioned between the fixing device 260 and the body 100, thereby completing fixation between the laptop lock 904 and the laptop 800. In this case, a lockset can be locked and attached to the lock hole 110 by the user. Because the lockset is locked and attached to the lock hole 110 of the laptop lock 904 and the material and size of the first support arm 360 of the laptop lock 904 can be changed according to design or usage requirements, a case of inability of locking and attaching caused by limits of the laptop (for example, the lock hole can not be set due to an excessive thin host or insufficient material strength) can be reduced.

Figure 5A:
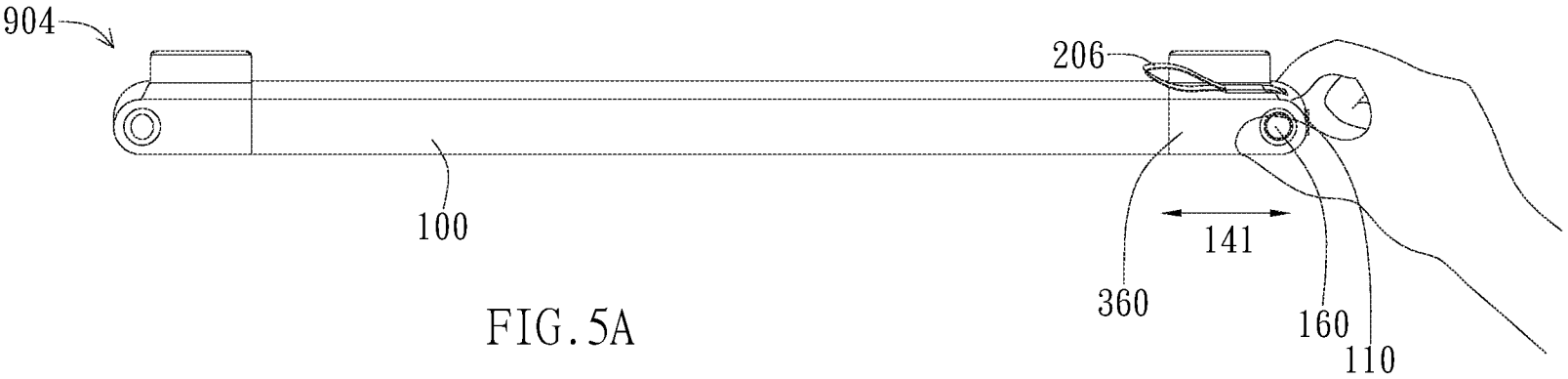
Figure 5B:
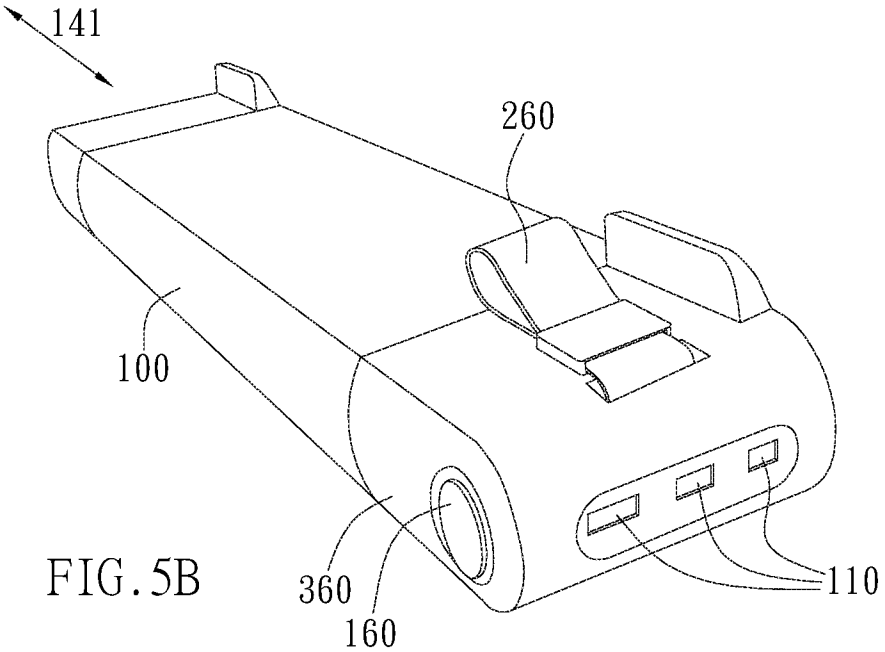
Figure 5C:
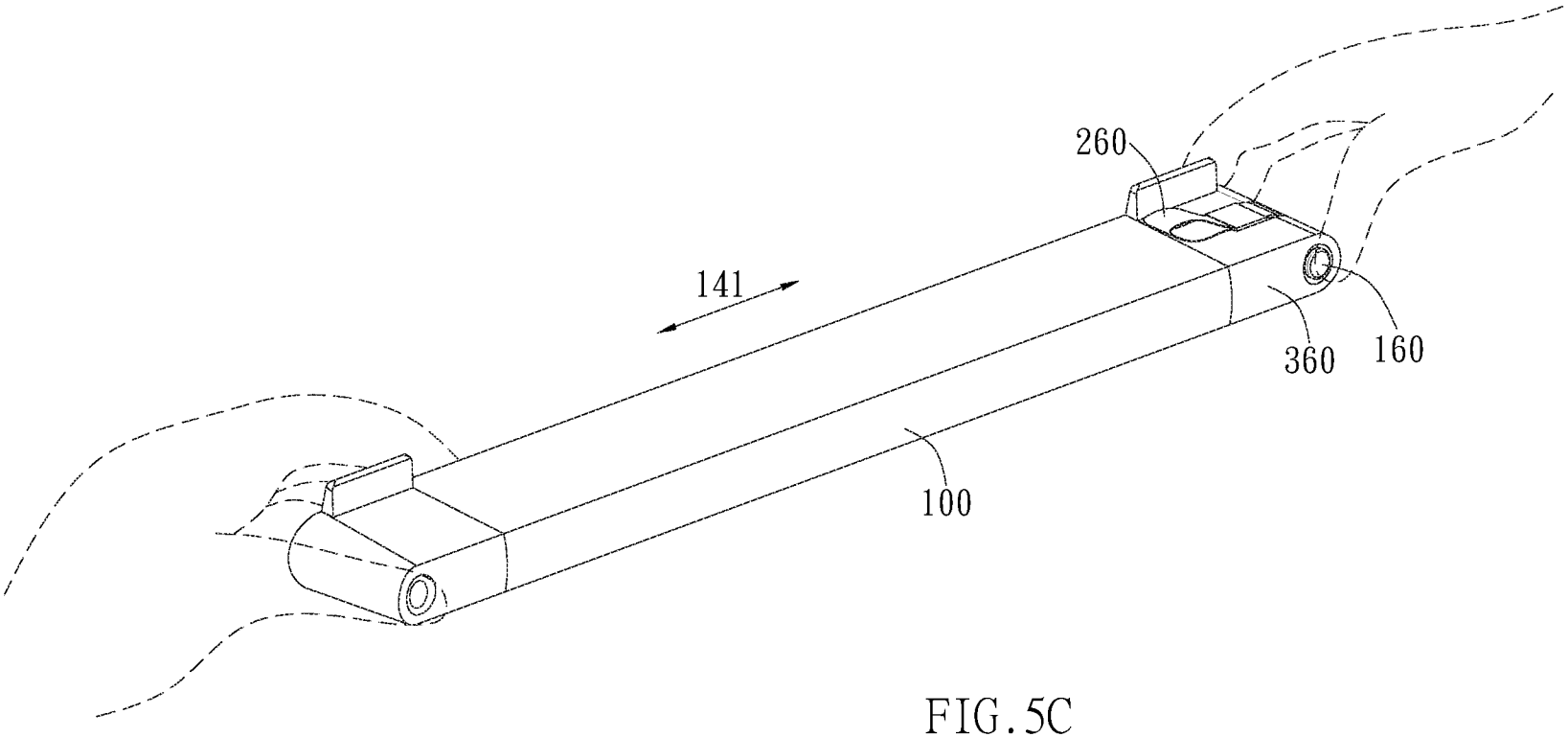
Figures 1, 2, 3, 5D:
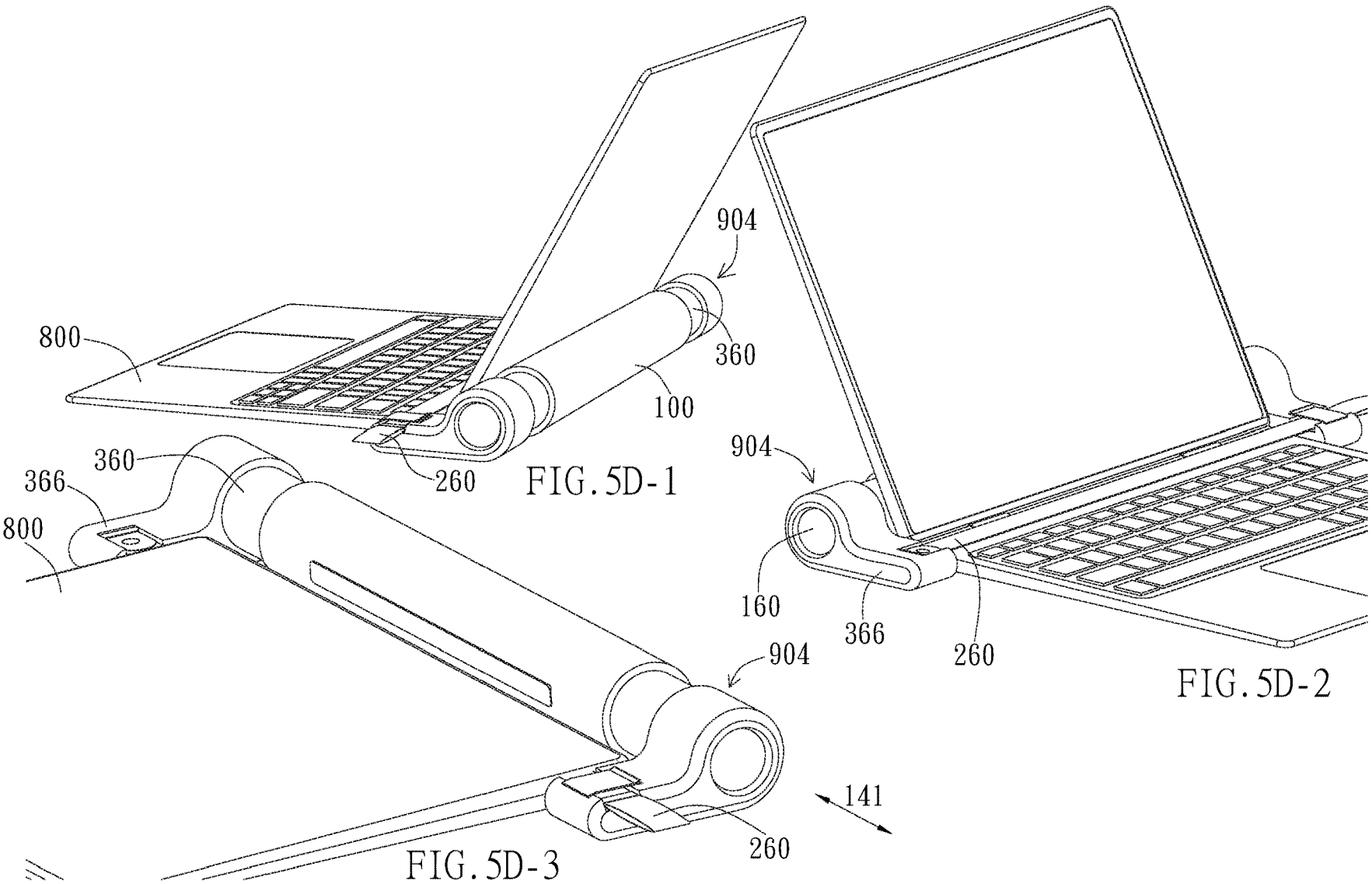
Figures 1, 5E:
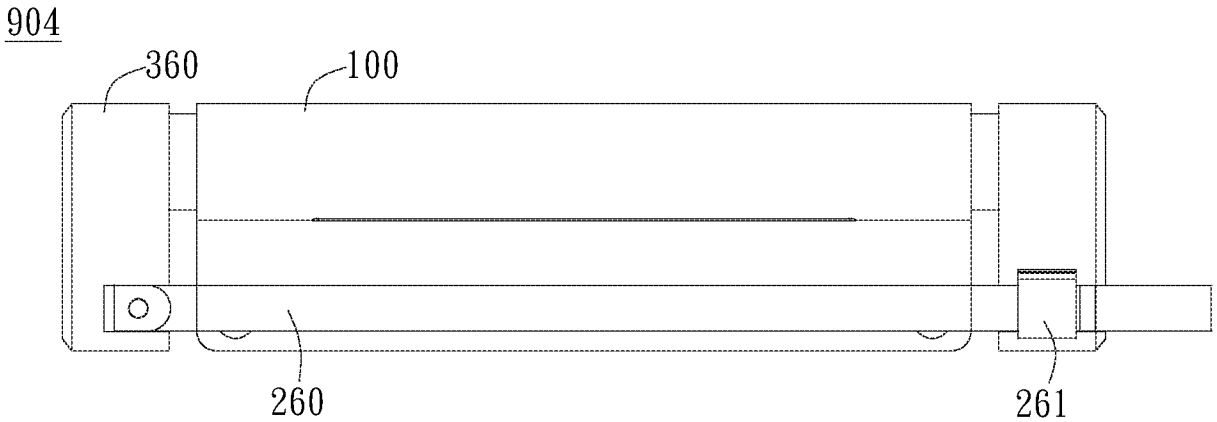
Figures 2, 5E:
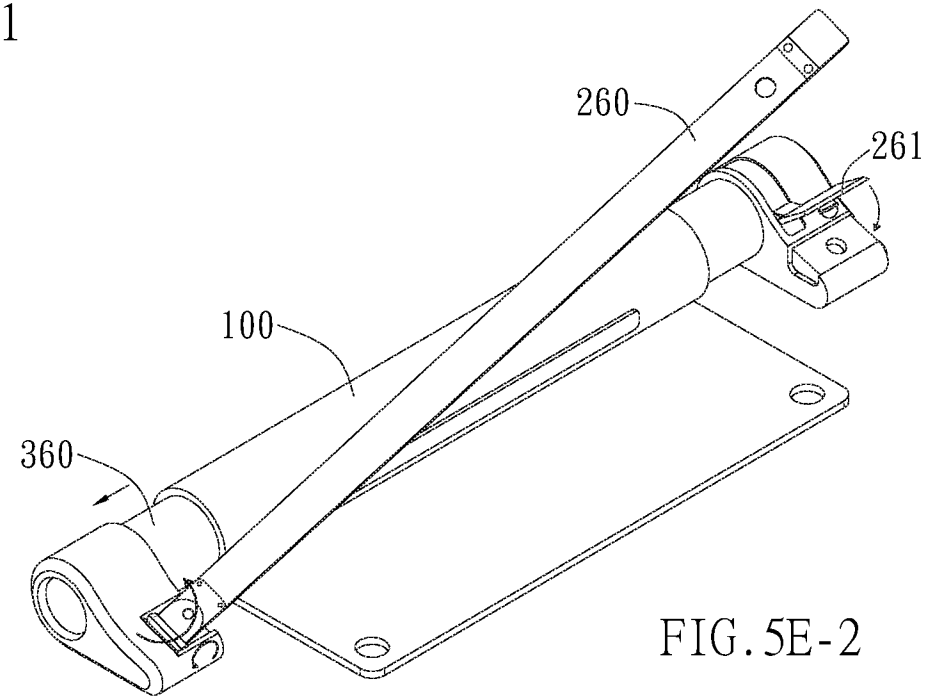
Figure 5F:
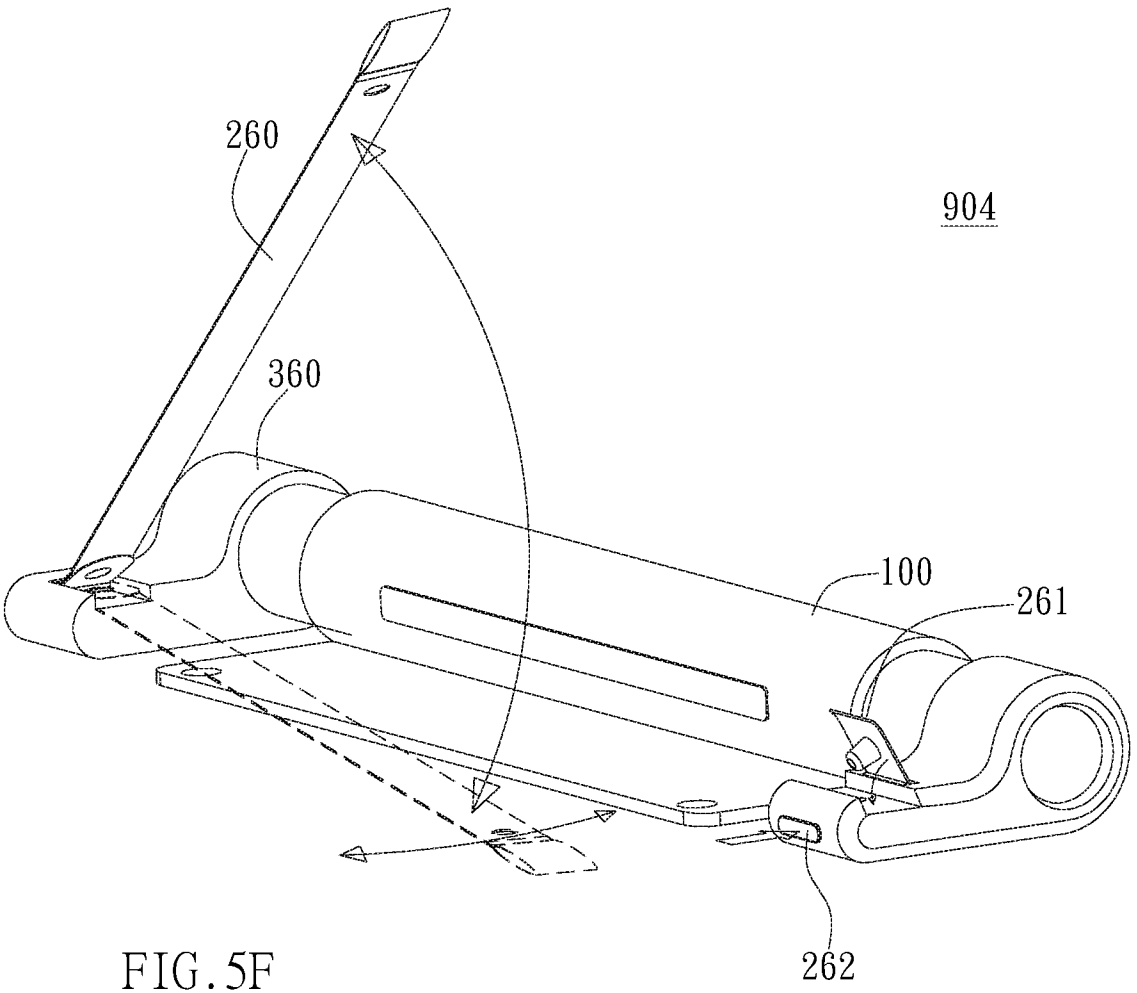
Figures 2, 5G:
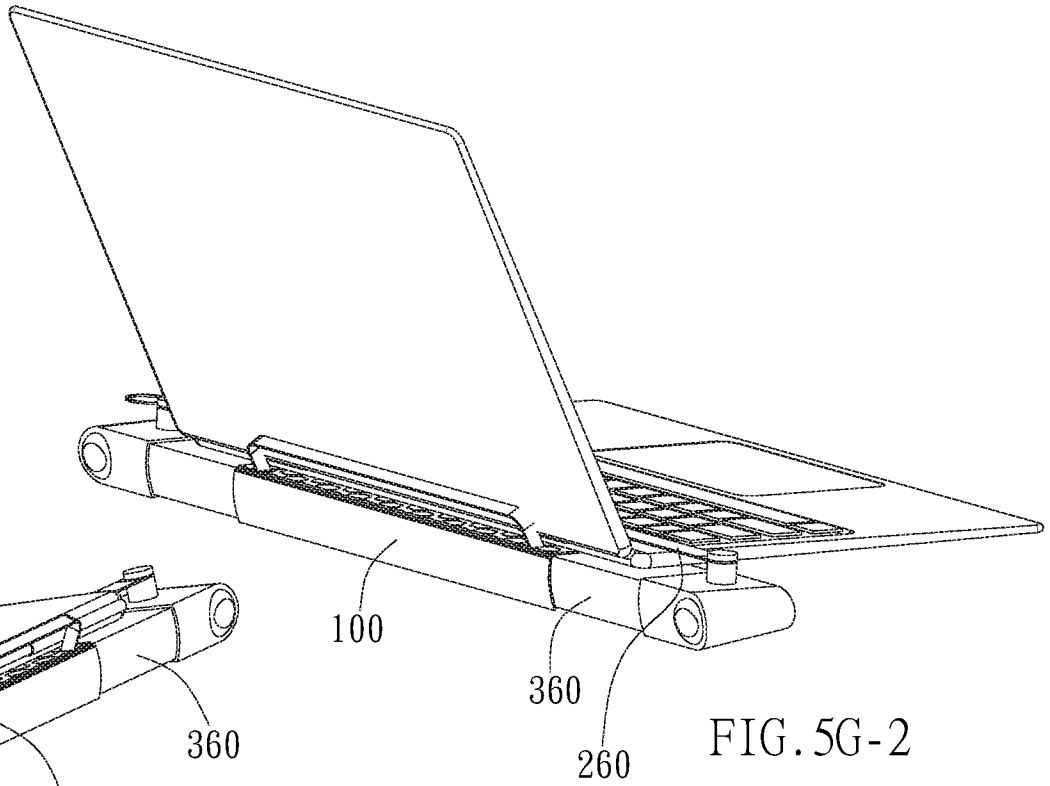
Figures 1, 5G:
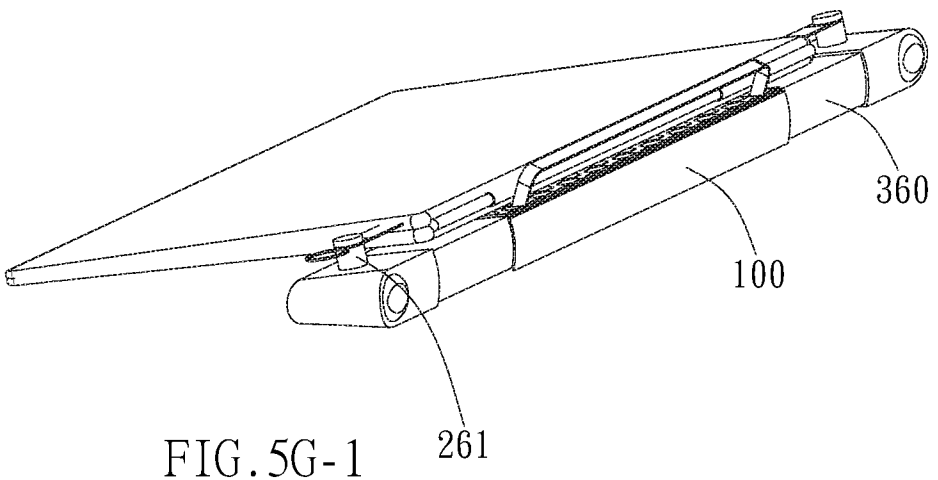
Figure 5H:
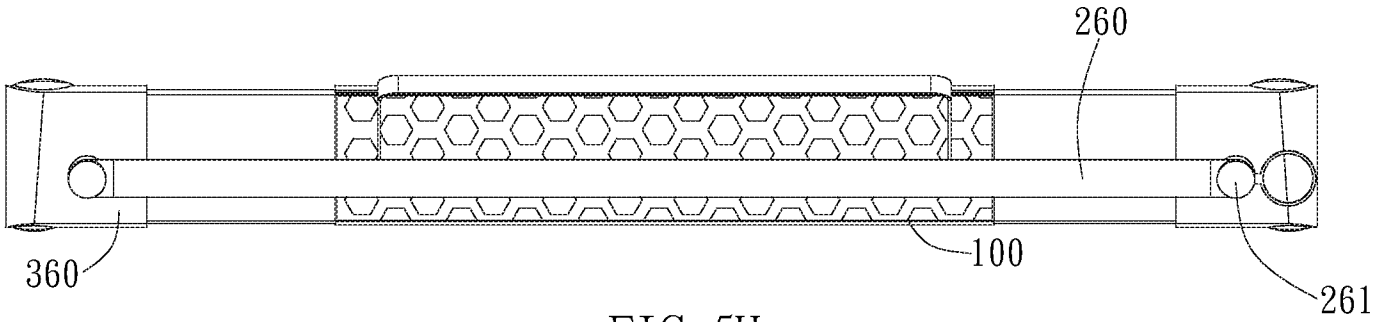
Figures 2, 5I:
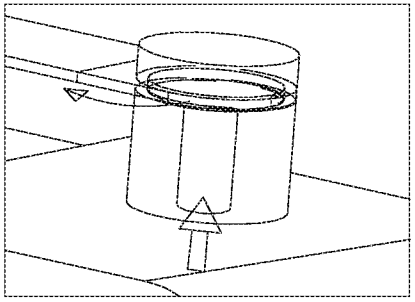
Figures 1, 5I:
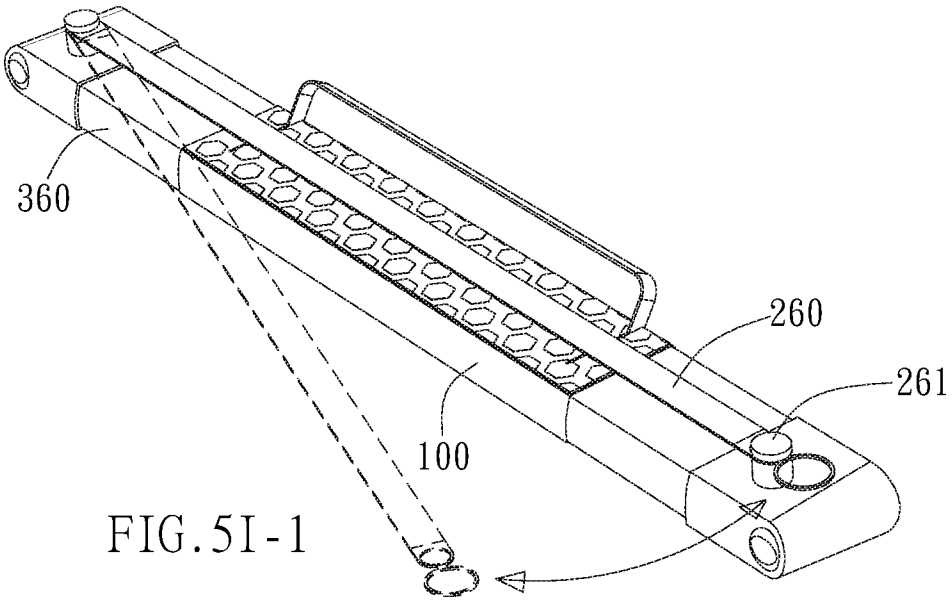

As the embodiment shown in FIG. 5F, one end of the body 100 is provided with a clamping component 261, and the fixing device 260 can be fixed at one end of the body 100 by virtue of the clamping component 261. One end of the body 100 is also provided with a clamping component control button 262 for controlling the clamping component 261 to be opened or closed. As the embodiments shown in FIGS. 5G-1 to 5I-2, the fixing device 260 and the clamping component 261 can have different settings according to usage, manufacture, or design requirements. A surface of the body 100 can be partially or completely covered with soft substances such as rubber so as to prevent the laptop 800 from being damaged.

Although the foregoing descriptions and drawings have disclosed the preferred embodiments of the present invention, it needs to be understood that various additions, many modifications and substitutions may be used in the preferred embodiments of the present invention without departing from the spirit and scope of the principle of the present invention as defined by the appended claims. One of ordinary skill in the art of the present invention can realize that the present invention can be used for modifications in many forms, structures, layouts, proportions, materials, components and assemblies. Therefore, the embodiments disclosed herein are intended to be used to illustrate the present invention but not limit the present invention.

What is claimed is:

1. A laptop lock used for locking a laptop, comprising:

a body having a support surface, wherein the support surface is provided with a first jack and a second jack respectively close to two opposite ends of the support surface of the body;

a fixing device including a first member bar and a second member bar, wherein the first member bar and the second member bar are connected by a first connecting part and a second connecting part, the fixing device is able to sleeve the screen for making the screen of the laptop pass through a gap between the first member bar and the second member bar, making the first connecting part and the second connecting part be inserted respectively into the first jack and the second jack, making the relative position of the body with respect to the laptop fixed, and making the extending direction of the shaft connecting the screen and the keyboard part of the laptop parallel with the long axial direction of the body.

2. The laptop lock of claim 1, wherein the laptop lock is used together with a lockset for locking the laptop, wherein the body further includes a lock hole disposed outside the support surface, wherein when the first connecting part and the second connecting part are inserted respectively into the first jack and the second jack, the lockset can insert into the lock hole to limit the movement of the fixing device relative to the body.

3. The laptop lock of claim 1, wherein the body further includes a lock and a control component, wherein the first connecting part and the second connecting part can be inserted respectively into the first jack and the second jack to limit the movement of the fixing device relative to the body;

wherein when the lock is in the locked state, the lock interferes with the fixing device, thereby limiting movement of the fixing device relative to the body;

wherein when the lock is in an unlocked state, the control component can be pressed to release the interference of the lock on the fixing device, thereby releasing the movement limit of the fixing device relative to the body.

4. The laptop lock of claim 3, wherein the laptop lock is used together with a cord for locking the laptop, wherein the body further includes a lock hole disposed outside the support surface, wherein when the first connecting part and the second connecting part are inserted respectively into the first jack and the second jack, one end of the cord can be inserted into the lock hole and limited from leaving the lock hole by the lock.

5. A laptop lock used for locking a laptop, comprising:

a body including a support surface;

a first support arm, wherein the first support arm can move outwards relative to one end of the body;

a second support arm, wherein the second support arm can move outwards relative to the other end of the body;

a fixing device, including:

a support unit arranged on the support surface, wherein the support unit can be rotationally lifted relative to the support surface;

a first limiting unit arranged on a surface of the first support arm, wherein the first limiting unit can be rotationally lifted relative to the support surface along the opposite direction with respect to the rotation direction of the support unit;

a second limiting unit arranged on a surface of the second support arm, wherein the second limiting unit can be rotationally lifted relative to the support surface along the opposite direction with respect to the rotation direction of the support unit;

the first support arm and the second support arm can move outwards relative to two ends of the body for making the screen of the laptop be positioned between the support unit, the first limiting unit, and the second limiting unit, making the relative position of the body with respect to the laptop fixed, and making extending direction of the shaft connecting the screen and the keyboard part of the laptop parallel with the long axial direction of the body.

6. The laptop lock of claim 5, wherein the laptop lock is used together with a lockset for locking the laptop, wherein the body further includes a lock hole disposed outside the support surface, wherein the lockset can insert into the lock hole to limit the movement of the first support arm and the second support arm with respect to the opposite ends of the body.

7. A laptop lock used for locking a laptop, comprising:

a body including a support surface;

a first support arm, wherein the first support arm can move outwards relative to one end of the body;

a second support arm, wherein the second support arm can move outwards relative to the other end of the body;

a fixing device, including:

a first limiting unit arranged on a surface of the first support arm, wherein the first limiting unit can be rotationally lifted relative to the support surface;

a second limiting unit arranged on a surface of the second support arm, wherein the second limiting unit can be rotationally lifted relative to the support surface;

the first support arm and the second support arm can move outwards relative to two ends of the body for making the screen of the laptop be positioned between the first limiting unit and the second limiting unit, making the relative position of the body with respect to the laptop fixed, and making the extending direction of the shaft connecting the screen and the keyboard part of the laptop parallel with the long axial direction of the body.

8. The laptop lock of claim 7, wherein the laptop lock is used together with a lockset for locking the laptop, wherein the body further includes a lock hole disposed outside the support surface, wherein the lockset can insert into the lock hole to limit the movement of the first support arm and the second support arm with respect to the opposite ends of the body.

* * * * *